US011251556B2

(12) United States Patent
Niitsu et al.

(10) Patent No.: US 11,251,556 B2
(45) Date of Patent: Feb. 15, 2022

(54) CONNECTOR AND CONNECTOR ASSEMBLY

(71) Applicant: Molex, LLC, Lisle, IL (US)

(72) Inventors: Toshihiro Niitsu, Yamato (JP); Yoshiteru Nogawa, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/706,883

(22) Filed: Dec. 9, 2019

(65) Prior Publication Data

US 2020/0203872 A1 Jun. 25, 2020

Related U.S. Application Data

(60) Provisional application No. 62/782,079, filed on Dec. 19, 2018.

(30) Foreign Application Priority Data

Mar. 20, 2019 (JP) ..... JP2019-052128

(51) Int. Cl.
*H01R 13/648* (2006.01)
*H01R 13/24* (2006.01)
*H01R 12/75* (2011.01)

(52) U.S. Cl.
CPC ..... *H01R 13/24* (2013.01); *H01R 12/75* (2013.01)

(58) Field of Classification Search
CPC .. H01R 23/725; H01R 13/518; H01R 23/662; H01R 2103/00; H01R 13/65802; H01R 23/6873; H01R 23/7073; H01R 13/24; H01R 12/75; H01R 13/516
USPC .... 439/74, 468, 497, 579, 580, 581, 607.28, 439/607.35, 660
See application file for complete search history.

(56) References Cited

U.S. PATENT DOCUMENTS 5,711,676 A * 1/1998 Michael, III ..... H01R 9/0518 439/581
6,830,478 B1 * 12/2004 Ko ..... H01R 13/6275 439/579

(Continued)

FOREIGN PATENT DOCUMENTS

CN 101238613 A 8/2008
CN 104682047 A 6/2015

(Continued)

*Primary Examiner* — Thanh Tam T Le

(57) ABSTRACT

A connector is provided that includes a housing and a terminal installed in the housing. The housing includes a receiving space in which the upper face receiving a counterpart connector is opened, a pair of side wall parts defining at least a portion of both the left and right sides of the receiving space, a front wall part defining at least a portion of the front of the receiving space, and a pair of rear wall parts defining at least a portion of the rear of the receiving space. The terminal includes a front contact part provided on the front of the receiving space so as to be adjacent to each side wall part, and a rear contact part provided on the rear of the receiving space so as to be adjacent to each side wall part. The front contact part and the rear contact part are disposed in nearly a straight line extending in the antero-posterior direction, face each other, and are capable of holding a counterpart terminal of the counterpart connector from the front and rear thereof.

6 Claims, 18 Drawing Sheets

(56) References Cited

U.S. PATENT DOCUMENTS 7,147,481 B2 * 12/2006 Yang ..... H01R 13/6582 439/71
7,168,986 B1 * 1/2007 Peng ..... H01R 12/716 439/607.04
7,467,975 B2 * 12/2008 Ma ..... H01R 13/2442 439/607.01
7,494,378 B1 * 2/2009 Peng ..... H01R 12/716 439/607.01
7,553,189 B2 * 6/2009 Tseng ..... H01R 13/2442 439/607.14
7,585,185 B2 * 9/2009 Obikane ..... H01R 12/52 439/607.01
7,717,719 B2 * 5/2010 Miyazaki ..... H01R 13/20 439/74
7,828,585 B2 * 11/2010 Kurimoto ..... H01R 12/716 439/468
7,892,028 B2 * 2/2011 Wu ..... H01R 9/038 439/607.28
7,955,129 B2 * 6/2011 Hu ..... H01R 13/506 439/607.01
8,043,114 B2 * 10/2011 Kaneko ..... H01R 12/716 439/497
8,105,112 B2 * 1/2012 Midorikawa ..... H01R 12/716 439/607.35
8,388,370 B2 * 3/2013 Yamaji ..... H01R 13/62994 439/497
8,602,812 B2 * 12/2013 Ohsaka ..... H01R 12/79 439/497
9,246,260 B2 * 1/2016 Naganawa ..... H01R 13/639
9,287,643 B2 * 3/2016 Yoshida ..... H01R 12/75
9,350,095 B2 * 5/2016 Arichika ..... H01R 13/6271
9,590,327 B2 * 3/2017 Matsuno ..... H01R 13/6275
10,084,265 B2 * 9/2018 Ozeki ..... H01R 13/6581
10,741,973 B2 * 8/2020 Yufu ..... H01R 12/774
2010/0184330 A1 7/2010 Wu

FOREIGN PATENT DOCUMENTS

CN 206388888 U 8/2017
CN 207459247 U 6/2018
JP 2011003292 A 1/2011
JP 2012-028303 A 2/2012
JP 2012028303 A 2/2012
JP 5351005 B2 11/2013
JP 5597030 B2 10/2014

* cited by examiner

Prior art

CONNECTOR AND CONNECTOR ASSEMBLY

RELATED APPLICATIONS

This application claims priority to Japanese Application No. 2019-052128 filed on Mar. 20, 2019, and U.S. Provisional application No. 62/782,079 filed on Dec. 19, 2018, each of which are incorporated herein by reference in their entirety.

TECHNICAL FIELD

The present disclosure relates to a connector and a connector assembly.

BACKGROUND ART

Conventionally, electric wire-to-substrate connectors for connecting electric wires such as cables to circuit boards such as printed circuit boards have been widely used for example, see Patent Document 1. In such an electric wire-to-substrate connector, an electric wire connector connected to the end part of the electric wire mates with a substrate connector mounted on a circuit board.

FIG. 18 is a perspective view prior to the mating of a conventional connector.

In the figure, 811 is a housing of a substrate connector and has a bottom plate part 812 along with a pair of side wall parts 814 which are connected to both the left and right ends of this bottom plate part 812. Moreover, 851 is a terminal of the substrate connector and is attached to each side wall part 814. In addition, when a tail part 853 of the terminal 851 is connected to a connection pad (formed on the surface of a circuit board (not illustrated)) via soldering, etc., the substrate connector is mounted on the circuit board. Moreover, a mating recess 813, the underside of which is defined by the bottom plate part 812 and both the left and right sides of which are defined by the side wall part 814, is formed in the center of the housing 811.

In addition, 911 is a housing of the electric wire connector and has an engagement projection 912 formed on the front and rear of the lower face along with an elastic piece 914 protruding downward from four corners. Moreover, terminals (not illustrated) which are connected to the end of a pair of electric wires 991 inserted in a terminal support hole 913 (formed in the housing 911) so as to be supported are attached to the lower face of the housing 911.

When the electric wire connector mates with the substrate connector, the housing 911 of the electric wire connector is housed in the mating recess 813 of the housing 811 of the substrate connector, with the terminal connected to the end of each electric wire 991 contacting the terminal 851 of the substrate connector so as to be conducted. Moreover, each engagement projection 912 of the housing 911 of the electric wire connector engages with the front end and rear end of the bottom plate part 812 of the housing 811 of the substrate connector. Herein an engagement claw 914*a* formed at the tip of the elastic piece 914 in the housing 911 of the electric wire connector engages with an engagement projection 814*a* formed on the side wall part 814 in the housing 811 of the substrate connector. As a result, the mating state between the electric wire connector and the substrate connector is maintained.

Patent Document 1: Japanese Unexamined Patent Application Publication No. 2012-28303.

SUMMARY

Unfortunately, in conventional connectors, the mating state between the electric wire connector and the substrate connector is maintained when the engagement projection 912 and the engagement claw 914*a* of the housing 911 made of resin, etc. engage with the bottom plate part 812 and the engagement projection 814*a* of the housing 811 similarly made of resin, etc. Therefore, the engagement maintenance force is not necessarily sufficient and, for example, as in the case in which an operator, etc. raises the electric wires 991 by hand, when strong external force is applied to the electric wire connector, the engagement is easily released. Specifically, the recent reduction in the size and thickness of electric apparatuses and electronic equipment with a connector mounted thereon has tended to lead to a reduction in the size and height of even the connector. Unfortunately, a reduction in the size and height of the housing 911 of the electric wire connector and the housing 811 of the substrate connector, in conventional connectors, causes a reduction in the size and thickness of the engagement projection 912, the engagement claw 914*a*, the bottom plate part 812, and the engagement projection 814*a*, leading to a further reduction in the engagement maintenance force.

Here, in order to solve the problems of conventional connectors, an object is to provide a connector and a connector assembly which provide a simple configuration which, even upon a reduction in size and height, is able to assuredly maintain the conduction state with a counterpart terminal and to assuredly maintain the mating state with a counterpart connector, thereby providing high reliability.

Therefore, a connector includes: a housing, and a terminal installed in the housing; wherein the housing includes: a receiving space in which the upper face receiving a counterpart connector is opened; a pair of side wall parts defining at least a portion of both the left and right sides of the receiving space; a front wall part defining at least a portion of the front of the receiving space; and a pair of rear wall parts defining at least a portion of the rear of the receiving space; wherein the terminal includes: a front contact part provided on the front of the receiving space so as to be adjacent to each side wall part; and a rear contact part provided on the rear of the receiving space so as to be adjacent to each side wall part; and wherein the front contact part and the rear contact part are disposed in nearly a straight line extending in the anteroposterior direction, face each other, and are capable of holding a counterpart terminal of the counterpart connector from the front and rear thereof.

Further, in another connector, the front contact part and the rear contact part elastically hold the counterpart terminal when the front contact part elastically deforms.

Further, in yet another connector, the front contact part is an elastically deformable band plate shaped member separated from the front wall part, and includes: an arm part which stretches towards the rear of the receiving space; and a contact curved part connected to the tip of the arm part; wherein the rear contact part is integrated with at least a portion of the rear wall part.

Further, in yet another connector, a recess engageable with the counterpart terminal is formed on the surface facing the front of the receiving space of the rear contact part.

Further, in yet another connector, the terminal includes a side part which is integrated with at least a portion of the side wall part so as to be exposed to the outer surface, wherein the front contact part and the rear contact part are respectively connected to the front end and rear end of the side part.

Further, in yet another connector, the terminal includes a reinforcing part which is integrated with at least a portion of the front wall part so as to be exposed to the outer surface, wherein the reinforcing part is provided closer to the center in the width direction of the housing than the front contact part so as not to contact the counterpart terminal.

A connector assembly includes: the connector, and a counterpart connector capable of mating with the connector.

Further, in another connector assembly, the counterpart connector includes: a counterpart housing and a counterpart terminal which is connected to the end of an electric wire and installed in the counterpart housing; wherein the periphery of the counterpart housing is defined by an upper surface, a bottom surface, left and right side surfaces, a front surface, and a rear surface, wherein the electric wire stretches backward from the rear surface, and wherein the counterpart terminal includes: a front plate part exposed to the front surface; and a rear plate part exposed to the rear surface, wherein the front plate part includes a contact point region which is disposed more externally in the width direction of the counterpart housing than the electric wire so as to be adjacent to the side surfaces, with the contact point region and the rear plate part disposed in nearly a straight line extending in the anteroposterior direction so as to be capable of being held by a front contact part and rear contact part of the terminal of the connector from the front and rear thereof.

According to the present disclosure, the connector and the connector assembly provide a simple configuration which, even upon a reduction in size and height, is able to assuredly maintain the conduction state with a counterpart terminal in addition to assuredly maintaining the mating state with a counterpart connector, thereby improving reliability.

BRIEF DESCRIPTION OF DRAWINGS

FIGS. 1A and 1B are perspective views seen from the diagonal rear of a receptacle connector and plug connector in a mated state according to Embodiment 1, wherein FIG. 1A is a view seen from the plug connector side, while FIG. 1B is a view seen from the receptacle connector side.

FIGS. 2A and 2B are perspective views seen from the diagonal front of the receptacle connector and plug connector in a mated state according to Embodiment 1, wherein FIG. 2A is a view seen from the plug connector side, while FIG. 2B is a view seen from the receptacle connector side.

FIGS. 4A-4D are four plane views of a first receptacle terminal according to Embodiment 1, wherein FIG. 4A is a top view, FIG. 4B is a cross sectional view in the arrow direction along line A-A in FIG. 4A, FIG. 4C is a cross sectional view in the arrow direction along line B-B in FIG. 4A, and FIG. 4D is a cross sectional view in the arrow direction along line C-C in FIG. 4A.

FIGS. 5A-5C are three plane views of the first receptacle terminal according to Embodiment 1, wherein FIG. 5A is a right side view, FIG. 5B is a front view, and FIG. 5C is a bottom view.

FIGS. 9A and 9B are perspective views of a first plug terminal connected to an electric wire according to Embodiment 1, wherein FIG. 9A is a perspective view of the first plug terminal connected to the electric wire seen diagonally from above, while FIG. 9B is a perspective view of the first plug terminal connected to the electric wire seen diagonally from below.

FIGS. 10A-10C are views describing the process for connecting the first plug terminal to the electric wire according to Embodiment 1, wherein FIG. 10A is a perspective view of the first plug terminal prior to connecting to the electric wire, FIG. 10B is a view illustrating the first process for connecting the electric wire to an electric wire connection part of the first plug terminal, and FIG. 10C is a view illustrating the second process for connecting the electric wire to the electric wire connection part of the first plug terminal.

FIGS. 12A and 12B are two plane views illustrating the state in which the housing of the mated receptacle connector and plug connector in Embodiment 1 is removed, wherein FIG. 12A is a top view, while FIG. 12B is cross sectional view in the arrow direction along line D-D in FIG. 12A.

FIGS. 14A and 14B are perspective views of the plug connector according to Embodiment 2 seen diagonally from below, wherein FIG. 14A is a view illustrating the state in which the housing is removed, while FIG. 14B is a view illustrating the state of a plug terminal alone.

FIGS. 15A and 15B are perspective views of a plug connector according to Embodiment 3, wherein FIG. 15A is a perspective view of the plug connector seen diagonally from above, while FIG. 15B is a perspective view illustrating the state in which a plug housing is removed from FIG. 15A.

FIGS. 16A-16D are perspective views of each part of a plug terminal according to Embodiment 3, wherein FIG. 16A is a perspective view of the plug terminal, FIG. 16B is a perspective view of a first plug terminal, FIG. 16C is a perspective view of a second plug terminal, and FIG. 16D is a perspective view of an insulating plate between terminals.

DETAILED DESCRIPTION OF THE PREFERRED EMBODIMENTS

An embodiment will be described in detail below with reference to the drawings.

Figure 1A:
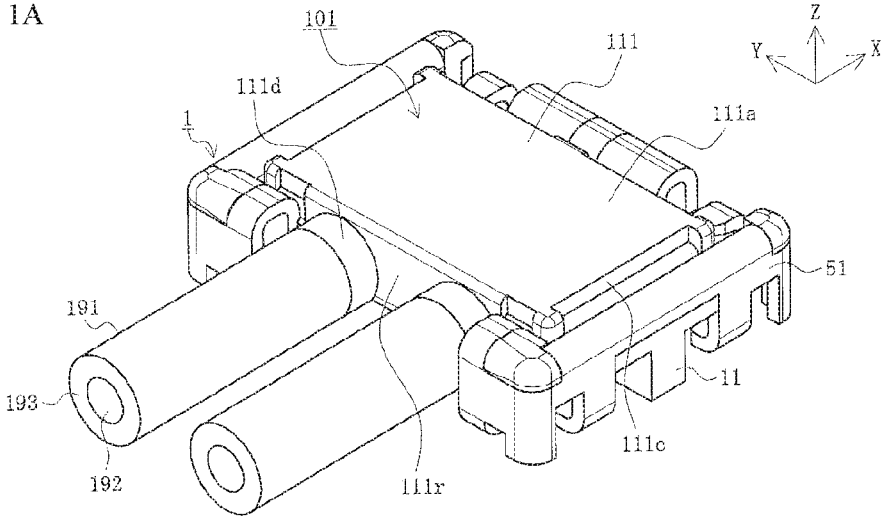
Figure 1B:
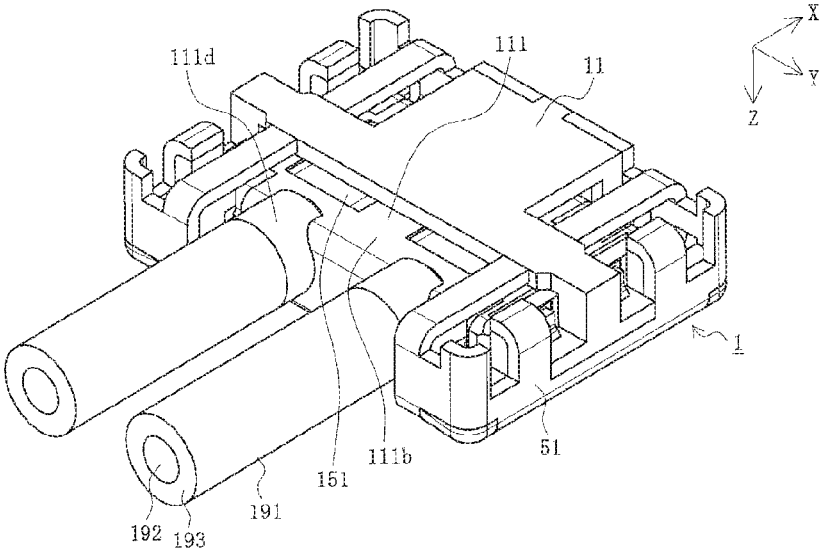
Figure 2A:
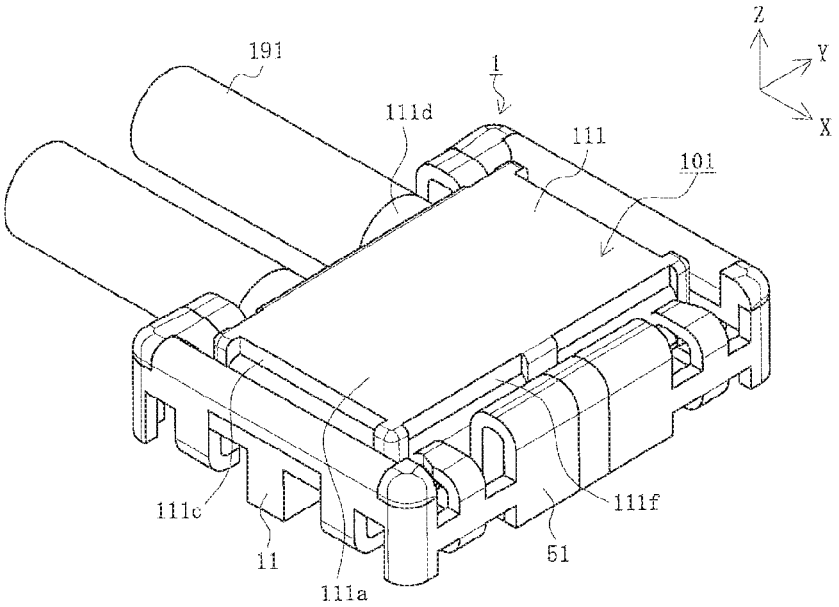
Figure 2B:
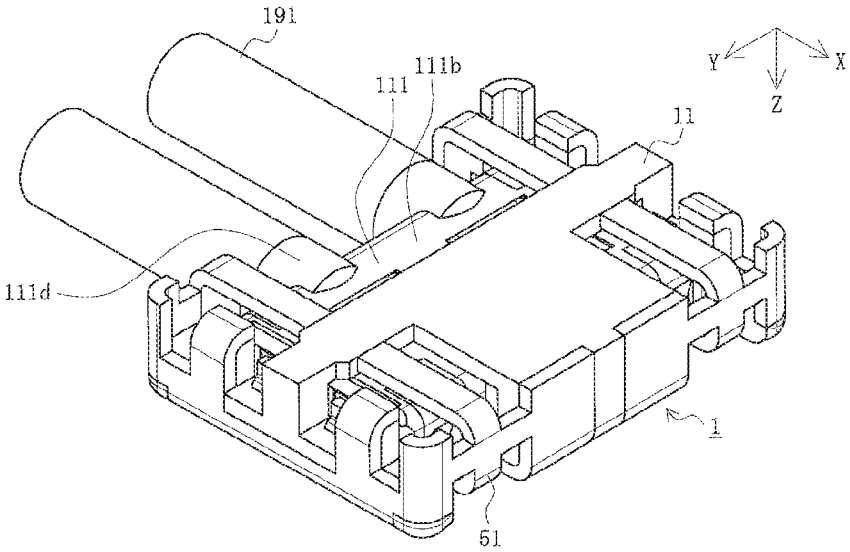

FIGS. 1A and 1B are perspective views seen from the diagonal rear of a receptacle connector and plug connector in a mated state according to Embodiment 1, while FIGS. 2A and 2B are perspective views seen from the diagonal front of the receptacle connector and plug connector in a mated state according to Embodiment 1. Note that in FIGS. 1A, 1B, 2A and 2B, FIGS. 1A and 2A are views seen from the plug connector side, while FIGS. 1B and 2B are a views seen from the receptacle connector side.

In the figures, 1 is a connector in the present embodiment, which is a receptacle connector serving as a substrate connector in an electric wire-to-substrate connector serving as a connector assembly, and is mounted on a substrate (not illustrated). The substrate is, for example, a printed circuit board, a flexible flat cable (FFC), or a flexible printed circuit board (FPC). The board, however, may be any type of substrate.

Moreover, 101 is a counterpart connector in the present embodiment, in addition to being a plug connector as the electric wire connector in the electric wire-to-substrate connector serving as the connector assembly, and is connected to the end of multiple (two in the example illustrated in the figure) electric wires 191, in addition to mating with the receptacle connector 1 in the direction (Z-axis direction) orthogonal to the surface of the substrate. Note that the electric wires 191 correspond to, for example, American Wire Gauge (AWG) #30 (outer diameter: 0.255 [mm]) or #28, etc., with any kind of electric wire that can turn on electricity, such as electric wires (using single core wires and strand wires) and coaxial electric wires, capable of being used. In the example illustrated in the figure, each electric wire 191 has: a core wire 192 as a conductive electric wire made of a conductive metal such as copper alloy; and an insulation coat 193 coating the periphery of this core wire 192.

The connector assembly consisting of the receptacle connector 1 and the plug connector 101 is used, for example, to connect an electric power line which connects a power source (such as batteries) and a member (for consuming an electric power), in electronic equipment, electrical appliances, etc., but can be used to connect a signal line. Note that electronic equipment, electrical appliances, etc. with the connector assembly attached thereto may be any kind of equipment, but are herein equipment having a size which is relatively small and can be carried by a person. In addition, the receptacle connector 1 is described as a receptacle connector wherein the dimensions in the anteroposterior direction, that is, in the length direction (X-axis direction) are approximately 1.2 [mm], the dimensions in the left and right direction, that is, in the width direction (Y-axis direction) are approximately 2.0 [mm], and the dimensions in the vertical direction, that is, in the thickness direction (Z-axis direction) are approximately 0.6 [mm]. These dimensions may be appropriately changed in accordance with the application of the connector assembly, the thickness and the number of electric wires 191, etc.

Note that expressions indicating directions, such as up, down, left, right, front, and back, used to describe the operations and configurations of each part of the receptacle connector 1 and the plug connector 101 in the present embodiment do not indicate absolute directions but rather relative directions. The expressed directions are relevant when each part of the receptacle connector 1 and the plug connector 101 are in their respective orientations illustrated in the figures. In the event the orientations of each part of the receptacle connector 1 and the plug connector 101 change, these directions should be interpreted differently in accordance with the new orientations after the change.

The receptacle connector 1 is a connector including the below-mentioned substantially recessed receiving space 13 receiving the plug connector 101, and includes: a receptacle housing 11 as a housing made of an insulating material such as resin; and a receptacle terminal 51 as a terminal made of a conductive metal and installed in the receptacle housing 11. Note that the receptacle housing 11 and the receptacle terminal 51 are configured to be planarly symmetric on the left and right with respect to the X-Z plane passing through the center in the width direction of the receptacle connector 1.

Moreover, the plug connector 101 is a connector having a box shaped outer shape which is housed in the receiving space 13, and includes: a plug housing 111 as a counterpart housing made of an insulating material such as resin; and a plug terminal 151 as a counterpart terminal made of a conductive metal and installed in the plug housing 111. Note that the plug housing 111 and the plug terminal 151 are configured to be planarly symmetric on the left and right with respect to the X-Z plane passing through the center in the width direction of the plug connector 101.

The plug housing 111 is a substantially rectangular parallelepiped member whose periphery is defined by an upper surface 111*a*, a bottom surface 111*b*, left and right side surfaces 111*c*, a front surface 111*f*, and a rear surface 111*r*, wherein an electric wire covering part 111*d* which covers a portion of the periphery of the electric wire 191 connected to the receptacle connector 1 is formed in the rear surface 111*r*. This electric wire covering part 111*d* is a cylindrical member which stretches backward (towards the negative X-axis direction) from the rear surface 111*r*. In the vertical direction, the electric wire covering part 111*d* includes: an upper end which is disposed so as to be the same as the position of the upper end of the upper surface 111*a* or lower than the position of the upper end of the upper surface 111*a*; and a lower end which is lower than the position of the lower end of the bottom surface 111*b*. That is, the outer diameter of the electric wire covering part 111*d* is larger than the dimensions in the thickness direction of the plug housing 111. Note that the outer diameter of the electric wire covering part 111*d* can be set as required, and in terms of a reduction in size and height of the plug connector 101, is preferably set to be equal to the outer diameter of the electric wire 191, that is, the outer diameter of the insulation coat 193. Moreover, the plug connector 101 has the electric wire covering part 111*d* and therefore does not require a crimping barrel for holding coated parts of electric wires used for general crimping terminals, making it possible to contribute to the reduction in size and height, as well as the cost reduction, of the plug connector 101 and the plug terminal 151.

Next, the configuration of the receptacle connector 1 will be described below in detail.

Figure 3:
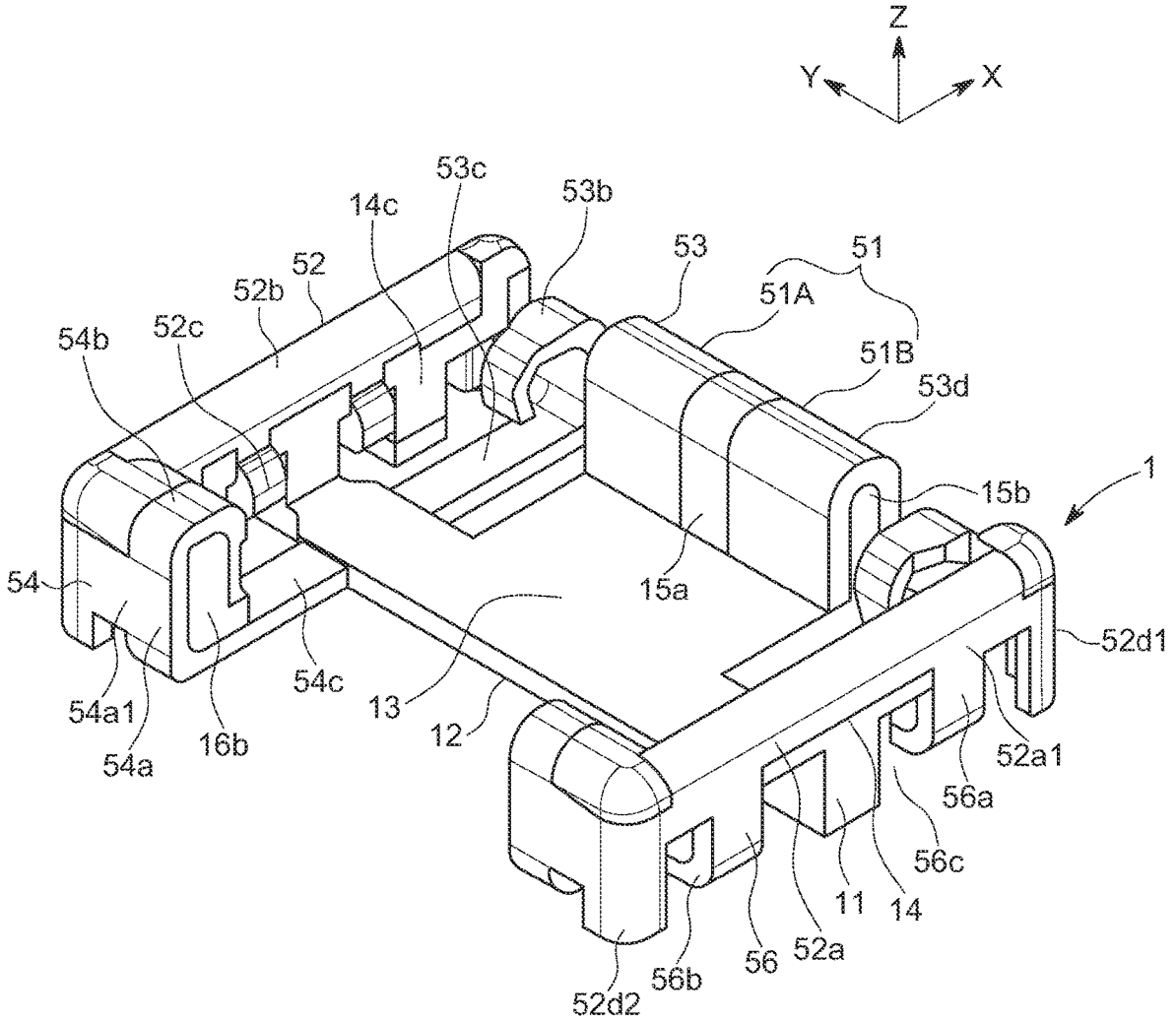
FIG. 3 is a perspective view of the receptacle connector according to Embodiment 1.
Figure 4B:
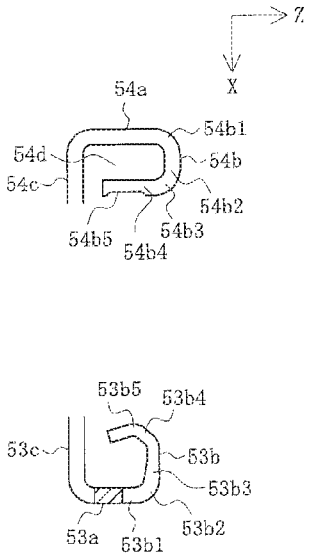
Figure 4A:
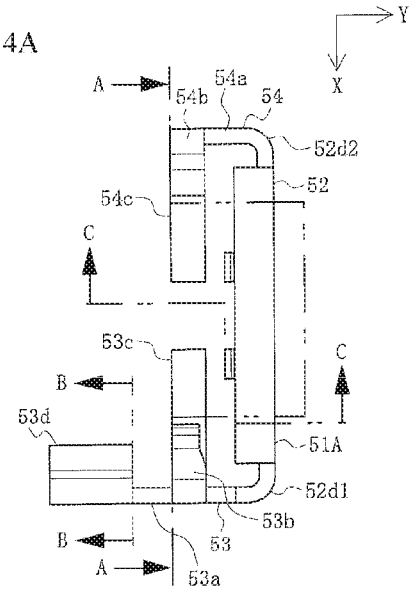
Figure 4C:
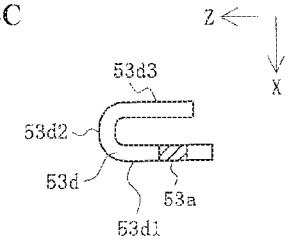
Figure 4D:
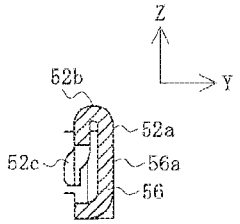
Figure 5A:
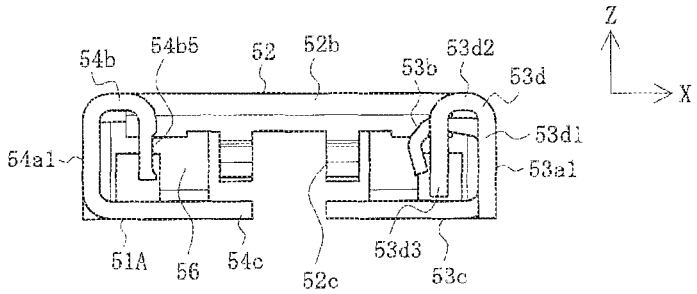
Figure 5B:
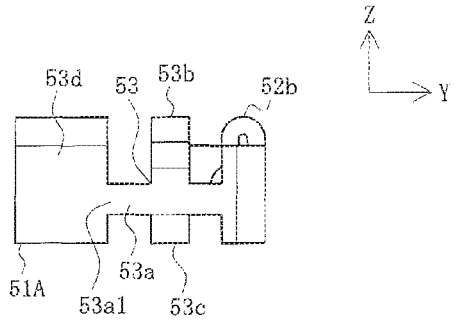
Figure 5C:
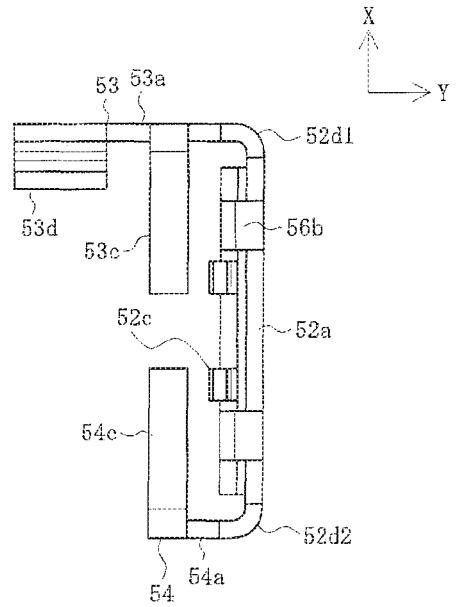
Figure 6:
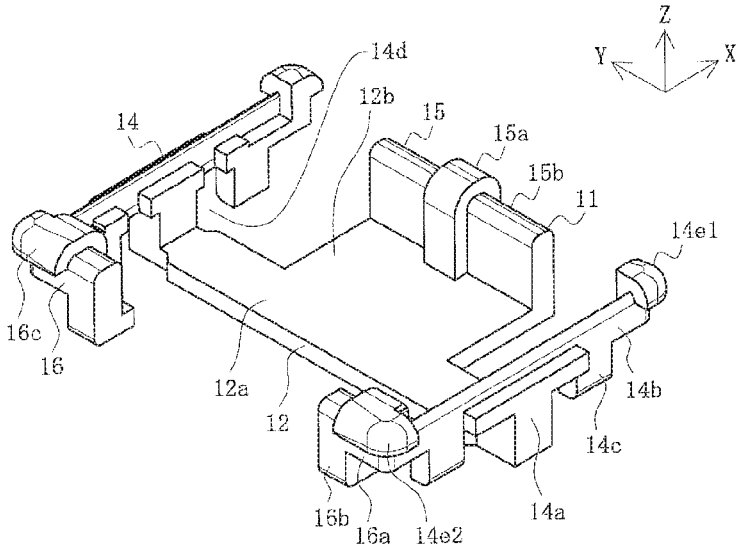
FIG. 6 is a perspective view of a receptacle housing according to Embodiment 1.
Figure 7:
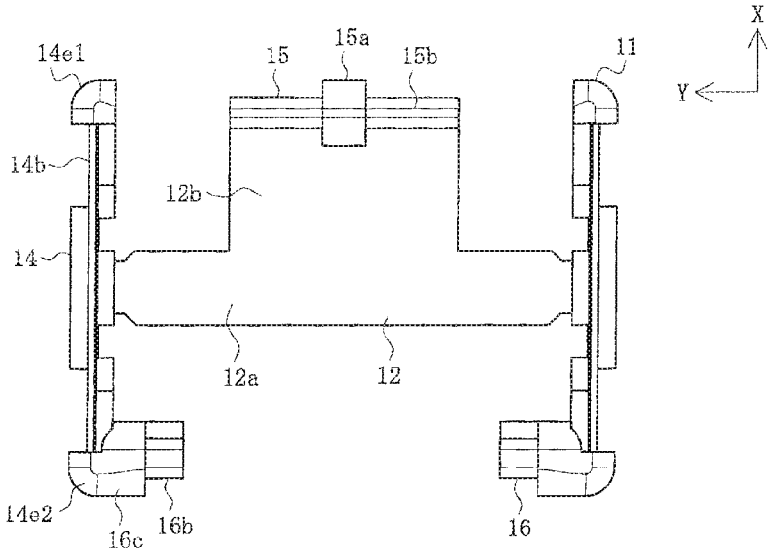
FIG. 7 is a top view of the receptacle housing according to Embodiment 1.

FIG. 3 is a perspective view of the receptacle connector according to Embodiment 1, FIGS. 4A-4D are four plane views of a first receptacle terminal according to Embodiment 1, FIGS. 5A-5C are three plane views of the first receptacle terminal according to Embodiment 1, FIG. 6 is a perspective view of a receptacle housing according to Embodiment 1, and FIG. 7 is a top view of the receptacle housing according to Embodiment 1. Note that in FIGS. 4A-4D, FIG. 4A is a top view, FIG. 4B is a cross sectional view in the arrow direction along line A-A in FIG. 4A, FIG. 4C is a cross sectional view in the arrow direction along line B-B in FIG. 4A, and FIG. 4D is a cross sectional view in the arrow direction along line C-C in FIG. 4A, while in FIGS. 5A-5C, FIG. 5A is a right side view, FIG. 5B is a front view, and FIG. 5C is a bottom view.

As illustrated in FIG. 3, the receptacle connector 1 is a member such as a short dish or tray having a substantially rectangular shape in a plan view, wherein, in the center thereof, the recessed receiving space 13 (in which the front (positive X-axis direction) and both the left and right sides (both Y-axis directions) are defined by low walls, while the upper part (positive Z-axis direction) is opened) is formed.

Moreover, the receptacle connector 1 includes: the receptacle housing 11 integrally formed with an insulating material such as resin; and the receptacle terminal 51 which is integrally formed by subjecting a conductive metal plate to processing such as punching, pressing, and folding. Note that the receptacle housing 11 is a member integrated with the receptacle terminal 51 via insert molding (overmolding) and is not independently present (while separated from the receptacle terminal 51), but for convenience of description, is depicted as independently present in FIGS. 6 and 7.

In addition, the receptacle terminal 51 forms a left and right pair, wherein the receptacle terminal disposed on the left (towards the positive Y-axis direction) is referred to as a first receptacle terminal 51A, while the receptacle terminal disposed on the right (towards the negative Y-axis direction) is referred to as a second receptacle terminal 51B. Note that the first receptacle terminal 51A and the second receptacle terminal 51B are configured to be planarly symmetric on the left and right with respect to the X-Z plane passing through the center in the width direction of the receptacle connector 1, with substantially no difference therebetween in the configuration. With that, when the first receptacle terminal 51A and the second receptacle terminal 51B are comprehensively described, they are described as the receptacle terminal 51. Note that only the first receptacle terminal 51A is depicted in FIGS. 4A-4D and FIGS. 5A-5C for convenience of illustration.

The receptacle terminal 51 includes: an elongated side part 52 which extends in the anteroposterior direction; and a front part 53 and a rear part 54 which are connected to the front end and rear end of this side part 52 via a front corner part 52*d*1 and a rear corner part 52*d*2 and stretch towards the center in the width direction of the receptacle connector 1.

The side part 52 is a part which is integrated with at least a portion of a side wall part 14 of the receptacle housing 11 so as to be exposed to the outer surface. In addition, the side part 52 includes: a flat plate shaped side plate part 52*a* extending in the anteroposterior direction; a coupling part 52*b* as a member which is connected to the upper end of this side plate part 52*a* so as to extend in the anteroposterior direction, in addition to having a substantially U shaped cross section; a cantilever beam shaped tab part 52*c* which stretches downward (negative Z-axis direction) from the lower end on the opposite side of the side plate part 52*a* among the lower end in this coupling part 52*b*; the front corner part 52*d*1 and the rear corner part 52*d*2 which are connected to both the front and rear ends of the side plate part 52*a*; and a substrate connection part 56 stretching downward from the lower end of the side plate part 52*a*. Note that the tab part 52*c* is disposed closer to the center in the width direction of the receptacle connector 1 than the side plate part 52*a*. Moreover, the tab part 52*c* is preferably bent such that the vicinity of the lower end thereof is disposed closer to the center in the width direction of the receptacle connector 1 than the vicinity of the upper end thereof.

The side plate part 52*a* is a flat plate shaped member which extends in the anteroposterior direction and the vertical direction as mentioned above, such that an outer surface 52*a*1 serving as the side face facing the outside in the width direction of the receptacle connector 1 is a flat face which configures a portion of the outer surface serving as the side face of the receptacle connector 1. Moreover, the outer surface 56*a* of the substrate connection part 56 is flush with the outer surface 52*a*1 and configures a portion of the outer surface serving as the side face of the receptacle connector 1. In the example illustrated in the figure, two of the substrate connection part 56 are formed so as to be arranged in parallel on the front and rear, wherein the lower end thereof serves as a connection end part 56*b* which is curved so as to stretch towards the center in the width direction of the receptacle connector 1. This connection end part 56*b* is a part which is connected to a conductive pad (formed on the surface of a substrate (not illustrated)) via a connection means such as soldering. Further, the front corner part 52*d*1 and the rear corner part 52*d*2 are members having a shape such as a portion of a cylindrical surface of a cylinder extending in the vertical direction extend, and as seen from above, as illustrated in FIG. 4A, a sector arc is drawn having a central angle of approximately 90° so as to couple both the front and rear ends of the side plate part 52*a* to the front part 53 and the rear part 54. In addition, in the vertical direction, the front corner part 52*d*1 and the rear corner part 52*d*2 have: an upper end which is disposed at nearly the same position as the side plate part 52*a*; and a lower end which is disposed below the side plate part 52*a* but at the same position as the lower face of the connection end part 56*b*. Further, the outer surface of the front corner part 52*d*1 and the rear corner part 52*d*2 configures a portion of the outer surface of the receptacle connector 1.

Moreover, in the example illustrated in the figure, the part between two substrate connection parts 56 below the side plate part 52*a* serves as a notch part 56*c*, wherein a portion of the side wall part 14 of the receptacle housing 11 is exposed in this notch part 56*c*. The surface exposed to the notch part 56*c* of this side wall part 14 is preferably substantially flush with the outer surface 52*a*1 of the side plate part 52*a* and the outer surface 56*a* of the substrate connection part 56. Note that it is not necessarily required that a portion of the side wall part 14 be exposed in the notch part 56*c*. Moreover, without forming this notch part 56*c*, the majority of the side faces of the receptacle connector 1 may be configured by the outer surface 52*a*1 of the side plate part 52*a* along with the outer surface 56*a* of the substrate connection part 56.

The front part 53 includes: an elongated band shaped front plate part 53*a* extending in the left and right direction; an elastically deformable front contact part 53*b* which is connected to the upper end of this front plate part 53*a* so as to stretch backward; a front beam part 53*c* which is connected to the lower end of the front plate part 53*a* so as to stretch backward; and a reinforcing part 53*d* which is connected to the center side end in the width direction of the receptacle connector 1 in the front plate part 53*a*. Note that the front contact part 53*b* and the front beam part 53*c* are connected to the upper end and lower end of the front plate part 53*a* at the same positions in the left and right direction, and overlap each other as seen from above as illustrated in FIG. 4(*a*).

In the front plate part 53*a*, an outer surface 53*a*1 serving as the side face facing the front of the receptacle connector 1 is a flat face which configures a portion of the outer surface serving as the front face of the receptacle connector 1.

Moreover, as illustrated in FIG. 4B, the front contact part 53*b* is an elastically deformable band plate shaped member (wherein, the overall side face shape is substantially U shaped), and contacts the plug terminal 151 of the plug connector 101 so as to function as an electrically connected connection part. In addition, the front contact part 53*b* includes: a base 53*b*1 stretching upward from the upper end of the front plate part 53*a*; a first curved part 53*b*2 which is connected to the upper end of this base 53*b*1 and curved at substantially 90° such that the tip thereof faces the rear of the receptacle connector 1; an arm part 53*b*3 which is connected to the tip of this first curved part 53*b*2 so as to stretch towards the rear of the receptacle connector 1; and a second curved part 53*b*4 as a contact curved part which is connected to the tip of this arm part 53*b*3 and curved at substantially 90° such that the tip thereof faces the lower diagonal front. In this second curved part 53*b*4, the outer surface of the part bulging out most towards the rear of the receptacle connector 1 functions as a front contact point 53*b*5 contacting the plug terminal 151.

The front beam part 53*c* is an elongated band shaped plate member which stretches from the lower end of the front plate part 53*a* to the rear of the receptacle connector 1, wherein, in the example illustrated in the figure, the tip thereof is disposed at nearly the same position as the front end of the notch part 56*c* of the side wall part 14 in the anteroposterior direction. Moreover, the lower face of the front beam part 53*c* is nearly flush with the lower face of the connection end part 56*b* of the substrate connection part 56.

As illustrated in FIG. 5A, the reinforcing part 53*d* is a member which is integrated with at least a portion of a front wall part 15 so as to be exposed to the outer surface, wherein the side face of the reinforcing part 53*d* is substantially U shaped. In addition, the reinforcing part 53*d* includes: an outer side part 53*d*1 which is connected to the front plate part 53*a* so as to extend in the vertical direction; a curved part 53*d*2 which is connected to the upper end of this outer side part 53*d*1 so as to be curved at substantially 180° such that the tip thereof faces downward; and an inner side part 53*d*3 which is connected to the tip of this curved part 53*d*2 so as to stretch downward. The side face facing the front of the receptacle connector 1 in the outer side part 53*d*1 is a flat face which is flush with the outer surface 53*a*1 of the front plate part 53*a* and configures a portion of the outer surface serving as the front face of the receptacle connector 1. Moreover, the side face facing the rear of the receptacle connector 1 in the inner side part 53*d*3 is a flat face which configures a portion of the surface defining the front of the receiving space 13 of the receptacle connector 1.

The rear part 54 includes: a band shaped rear plate part 54*a* extending in the left and right direction; a rear contact part 54*b* which is connected to the upper end of this rear plate part 54*a* so as to stretch forward; and a rear beam part 54*c* which is connected to the lower end of the rear plate part 54*a* so as to stretch forward. Note that the rear contact part 54*b* and the rear beam part 54*c* are connected to the upper end and lower end of the rear plate part 54*a* at the same positions in the left and right direction and overlap each other as seen from above as illustrated in FIG. 4A. Moreover, the rear contact part 54*b* and the rear beam part 54*c* are disposed at the same positions as the front contact part 53*b* and the front beam part 53*c* in the left and right direction.

In the rear plate part 54*a*, an outer surface 54*a*1 serving as the side face facing the rear of the receptacle connector 1 is a flat face which configures a portion of the outer surface serving as the rear face of the receptacle connector 1.

Moreover, as illustrated in FIG. 4B, the rear contact part 54*b* is a band plate shaped member (wherein, the overall side face shape is substantially U shaped) and contacts the plug terminal 151 of the plug connector 101 so as to function as an electrically connected connection part. In addition, the rear contact part 54*b* includes: a first curved part 54*b*1 which is connected to the upper end of the rear plate part 54*a* and curved at substantially 90° such that the tip thereof faces the front of the receptacle connector 1; an upper beam part 54*b*2 which is connected to the tip of this first curved part 54*b*1 so as to stretch towards the front of the receptacle connector 1; a second curved part 54*b*3 which is connected to the tip of this upper beam part 54*b*2 and curved at substantially 90° such that the tip thereof faces downward; and a contact plate part 54*b*4 which is connected to the tip of this second curved part 54*b*3 so as to stretch downward. In this contact plate part 54*b*4, a rear contact point recess 54*b*5, as a recess which can contact and engage with the plug terminal 151, is preferably formed on the surface facing the front of the receptacle connector 1.

Note that the rear contact part 54*b* preferably has high rigidity and does not elastically deform. That is, the contact plate part 54*b*4 is preferably not elastically displaced in the anteroposterior direction. Consequently, a rear contact part inner space 54*d* serving as a space between the rear plate part 54*a* and the rear contact part 54*b* is preferably filled with a portion of resin making up the receptacle housing 11.

The rear beam part 54*c* is an elongated band shaped plate member which stretches from the lower end of the rear plate part 54*a* to the front of the receptacle connector 1, wherein, in the example illustrated in the figure, the tip thereof is disposed at nearly the same position as the rear end of the notch part 56*c* of the side wall part 14 in the anteroposterior direction. Moreover, the lower face of the rear beam part 54*c* is nearly flush with the lower face of the connection end part 56*b* of the substrate connection part 56.

Further, the front contact part 53*b* and the front beam part 53*c*, as well as the rear contact part 54*b* and the rear beam part 54*c*, are disposed parallel to the X-axis, that is, in nearly a straight line extending in the anteroposterior direction, in a plan view, that is, as seen from above, as illustrated in FIG. 4A. Moreover, the front contact part 53*b* and the rear contact part 54*b* face each other and are integrally formed together with each part of the front part 53, a side part 52, and the rear part 54. Thereby, the distance between the front contact part 53*b* and the rear contact part 54*b* can be assuredly maintained.

The receptacle housing 11 includes: a bottom wall part 12 defining at least a portion of the underside of the receiving space 13; a pair of left and right side wall parts 14 defining at least a portion of both the left and right sides of the receiving space 13; a front wall part 15 defining at least a portion of the front of the receiving space 13; and a rear wall part 16 defining at least a portion of the rear of the receiving space 13.

As illustrated in FIG. 7, the bottom wall part 12 is a flat plate shaped member having a substantially T shape as seen from above. In addition, the bottom wall part 12 includes: a main body part 12*a* extending in the left and right direction; and an extension part 12*b* stretching forward from the center in the left and right direction at the front end of this main body part 12*a*. Note that the bottom wall part 12 is absent behind the rear end of the main body part 12*a*, while the lower part of the receiving space 13 is opened in the range from the rear end of the main body part 12*a* to the rear wall part 16.

As mentioned above, because the receptacle housing 11 is configured to be planarly symmetric on the left and right with respect to the X-Z plane passing through the center in the width direction of the receptacle connector 1, the left and right side wall parts 14 are also configured to be mutually planarly symmetric on the left and right with respect to the X-Z plane passing through the center in the width direction of the receptacle connector 1, with substantially no difference therebetween in the configuration. In addition, each side wall part 14 includes: a main body part 14*a* connected to both the left and right ends of the main body part 12*a* of the bottom wall part 12; an elongated side beam part 14*b* which is connected to the upper end of this main body part 14*a* so as to extend in the anteroposterior direction; a front corner cap 14*e*1 and a rear corner cap 14*e*2 which are connected to the upper end thereof, on both the front and rear ends of this side beam part 14*b*; and a connection leg 14*c* stretching downward from the lower end of the side beam part 14*b*.

The main body part 14*a* is a relatively thick member, wherein the entire side face is substantially T shaped and the side face facing the outside in the width direction of the receptacle connector 1 is a flat face which is nearly flush with the outer surface 52*a*1 of the side plate part 52*a* of the receptacle terminal 51 and configures a portion of the outer surface serving as the side face of the receptacle connector 1. Moreover, the side face facing the center in the width direction of the receptacle connector 1 in the main body part 14*a* is a flat face which is nearly flush with the side face facing the center in the width direction of the receptacle connector 1 in the coupling part 52*b* of the receptacle terminal 51 and configures a portion of the internal surface of the walls defining the side of the receiving space 13.

The side beam part 14*b* is a thin elongated band shaped member (wherein, the dimensions in the width direction of the receptacle connector 1 are smaller than the main body part 14*a*) and is preferably adhered and housed in an internal space having a substantially U shaped cross section in the coupling part 52*b* of the receptacle terminal 51. As a result, the coupling part 52*b* has improved rigidity and tends not to be deformed. Moreover, each of the front corner cap 14*e*1 and the rear corner cap 14*e*2 is a member which has a shape such as a quarter of a hemisphere and covers the upper face of the front corner part 52*d*1 and the rear corner part 52*d*2. In the example illustrated in the figure, as in the substrate connection part 56, two connection legs 14*c* are formed so as to be arranged in parallel on the front and rear, the side face facing the outside in the width direction of the receptacle connector 1 in each connection leg 14*c* is preferably adhered to the side face facing the center in the width direction of the receptacle connector 1 in the corresponding substrate connection part 56, while the lower face in each connection leg 14*c* is preferably adhered to the upper face of the connection end part 56*b*. As a result, the substrate connection part 56 including the connection end part 56*b* has improved rigidity and tends not to be deformed. Note that the side face facing the center in the width direction of the receptacle connector 1 in each connection leg 14*c* is nearly flush with the side face facing the center in the width direction of the receptacle connector 1 in the main body part 14*a*.

Moreover, below the side beam part 14*b*, a tab housing notch 14*d* is formed between the main body part 14*a* and the connection legs 14*c* disposed on the front and rear thereof. The tab part 52*c* of the receptacle terminal 51 is housed in the tab housing notch 14*d* serving as a space, thereby allowing it to be elastically displaced in the width direction of the receptacle connector 1.

The front wall part 15 is a member stretching upward from the front end of the extension part 12*b* of the bottom wall part 12 and a plate member extending in the left and right direction and the vertical direction. In addition, the front wall part 15 includes: a relatively thick main body part 15*a*; and a pair of relatively thin wall parts 15*b* stretching from this main body part 15*a* in both the left and right directions. Each of the left and right thin wall parts 15*b* is preferably adhered and housed in an internal space having a substantially U shaped cross section in each reinforcing part 53*d* of the receptacle terminal 51. As a result, each reinforcing part 53*d* has improved rigidity and tends not to be deformed. Moreover, the main body part 15*a* is housed between the reinforcing part 53*d* of the first receptacle terminal 51A and the reinforcing part 53*d* of the second receptacle terminal 51B. In addition, the entire outer surface of the main body part 15*a* is nearly flush with the entire outer surface of the reinforcing part 53*d*. Therefore, the outer surface of the main body part 15*a* configures a portion of the internal surface, external surface, and upper face of the walls defining the front of the receiving space 13, together with the outer surface of the reinforcing part 53*d*. Moreover, when the main body part 15*a* is integrated with the reinforcing parts 53*d* of the left and right first receptacle terminal 51A and second receptacle terminal 51B, the left and right reinforcing parts 53*d* are integrally firmly bonded, such that the left and right first receptacle terminal 51A and second receptacle terminal 51B are integrally firmly bonded.

The rear wall part 16 is a member stretching from the rear end of the side wall part 14 towards the center in the width direction of the receptacle connector 1. However, the dimensions in the width direction of the receptacle connector 1 are small. Therefore, the rear wall part 16 is divided into the left and right, while between the left and right rear wall parts 16, a space of larger dimensions than the dimensions in the left and right direction of the bottom wall part 12 is present. Therefore, the rear of the receiving space 13 is opened within the range of this space. As illustrated in FIGS. 1A, 1B, 2A and 2B, in the mating state between the receptacle connector 1 and the plug connector 101, two electric wires 191 pass through the space.

In addition, the rear wall part 16 includes: a main body part 16*a* which is connected to the rear end of the side beam part 14*b* so as to stretch from this rear end towards the center in the width direction of the receptacle connector 1; a rear contact reinforcing part 16*b* which is connected to the tip of this main body part 16*a* so as to stretch downward; and a rear wall cap 16*c* connected to the upper end of the main body part 16*a*.

The main body part 16*a* is preferably adhered to the side face facing the front in the rear plate part 54*a* of the receptacle terminal 51. As a result, the rear plate part 54*a* has improved rigidity and tends not to be deformed. Moreover, the rear contact reinforcing part 16*b* is preferably adhered and housed in the rear contact part inner space 54*d* serving as a space between the rear plate part 54*a* and the rear contact part 54*b* in the rear part 54 of the receptacle terminal 51. As a result, the rigidity of the rear contact part 54*b* is improved, preventing elastic displacement of the contact plate part 54*b*4 in the anteroposterior direction. Further, the rear wall cap 16*c* is a member which is integrated with the rear corner cap 14*e*2 and coats a region with the rear contact part 54*b* not connected thereto at the upper end of the rear plate part 54*a*. In addition, the outer peripheral surface of the rear wall cap 16*c* is nearly flush with the outer peripheral surface of the rear contact part 54*b* and the overall side face shape is substantially U shaped.

As mentioned above, the receptacle connector 1 is obtained by integrating the receptacle housing 11 and the receptacle terminal 51 via insert molding (overmolding). Specifically, a conductive metal plate is first subjected to processing such as punching, pressing, and folding to mold the first receptacle terminal 51A and the second receptacle terminal 51B. Subsequently, the first receptacle terminal 51A and the second receptacle terminal 51B are disposed in the molding die so as to abut the inner face in the left and right direction and the anteroposterior direction of a molding die (not illustrated). Subsequently, this molding die is filled with an insulating material such as fused resin and this insulating material is cooled and solidified, after which a molded product is extracted from the molding die. As a result, the receptacle connector 1 can be obtained, wherein the receptacle housing 11 and the receptacle terminal 51 as illustrated in FIG. 3 are integrated.

Note that when the first receptacle terminal 51A and the second receptacle terminal 51B are disposed in the molding die as mentioned above, the flow pressure of the fused insulating material which flows in this molding die is applied to each of the first receptacle terminal 51A and the second receptacle terminal 51B. As a result, in the first receptacle terminal 51A and the second receptacle terminal 51B, each outer surface of the side part 52, the front part 53, and the rear part 54, as well as each upper face of the coupling part 52*b*, the reinforcing part 53*d*, and the rear contact part 54*b*, is assuredly adhered to the inner face of the molding die. Consequently, the first receptacle terminal 51A and the second receptacle terminal 51B are accurately positioned relative to the receptacle housing 11, making it possible to reduce the tolerance of the distance between the first receptacle terminal 51A and the second receptacle terminal 51B, in addition to obtaining a receptacle connector 1 having good positional accuracy.

Moreover, the insulating material enters between the coupling part 52*b* and the side plate part 52*a*, between the reinforcing part 53*d* and a front plate part 53*a*, and between the rear contact part 54*b* and the rear plate part 54*a*, in the receptacle terminal 51. Accordingly, the coupling part 52*b*, the reinforcing part 53*d*, and the rear contact part 54*b* are integrated with the side wall part 14, the front wall part 15, and the rear wall part 16, in the receptacle housing 11, thereby preventing the coupling part 52*b*, the reinforcing part 53*d*, and the rear contact part 54*b* from elastically deforming. Therefore, the receptacle connector 1 can include a rigid structure. In contrast, the insulating material is not adhered to the periphery of the tab part 52*c* and the front contact part 53*b* in the receptacle terminal 51, such that the tab part 52*c* and the front contact part 53*b* can be elastically deformed while remaining unrestrained, so as to assuredly abut the plug connector 101.

Further, the side faces, front face, and rear face of the receptacle connector 1 are configured by the outer surfaces and upper faces of the side part 52, front part 53, and rear part 54, of the receptacle terminal 51, along with the outer surfaces and upper faces of the side wall part 14, front wall part 15, and rear wall part 16, of the receptacle housing 11. Similarly, the inner face of the receptacle connector 1 is configured by the internal surfaces of the coupling part 52*b*, reinforcing part 53*d*, and rear contact part 54*b*, of the receptacle terminal 51, along with the inner face of the receptacle housing 11.

Moreover, the free ends (tips) of the front beam part 53*c* and the rear beam part 54*c* are integrally molded and fixed to the front end and rear end of the main body part 12*a* of the bottom wall part 12. As mentioned above, because the front contact part 53*b* and the front beam part 53*c* of the receptacle terminal 51, as well as the rear contact part 54*b* and the rear beam part 54*c*, are disposed in nearly a straight line extending in the anteroposterior direction, the rear contact part 54*b* into which the insulating material has entered can directly receive the elastic force of the front contact part 53*b*, suppressing the deformation volume. Moreover, the front beam part 53*c* and the rear beam part 54*c* function as beams, making it possible to further suppress the deformation volume.

The configuration of the plug connector 101 will hereinafter be described in detail.

Figure 8:
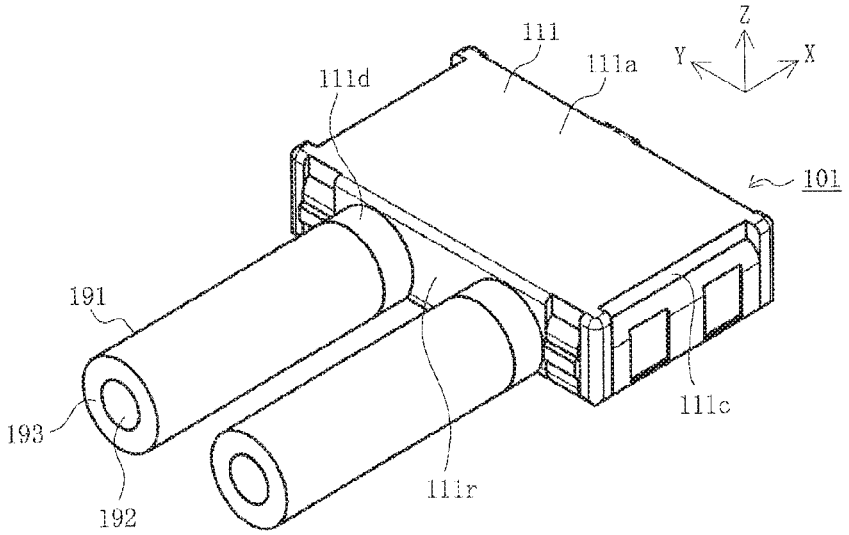
FIG. 8 is a perspective view of the plug connector according to Embodiment 1.
Figure 9A:
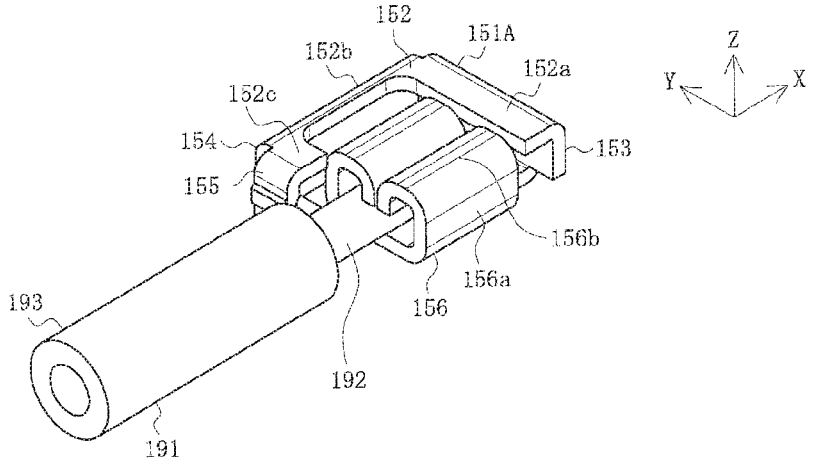
Figure 9B:
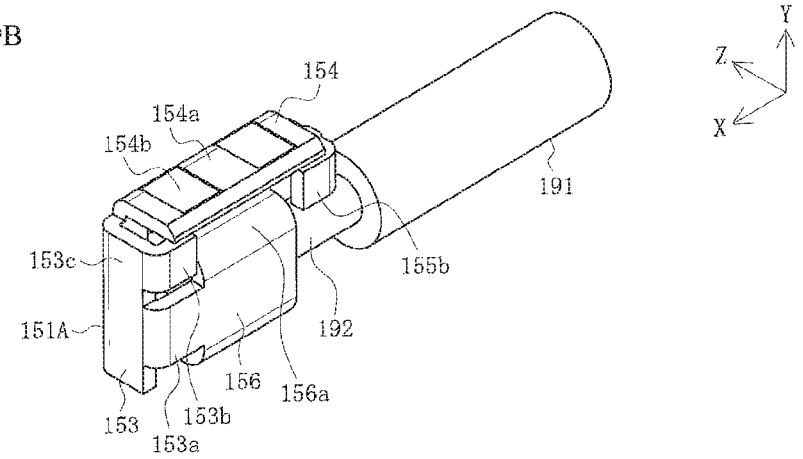
Figure 10A:
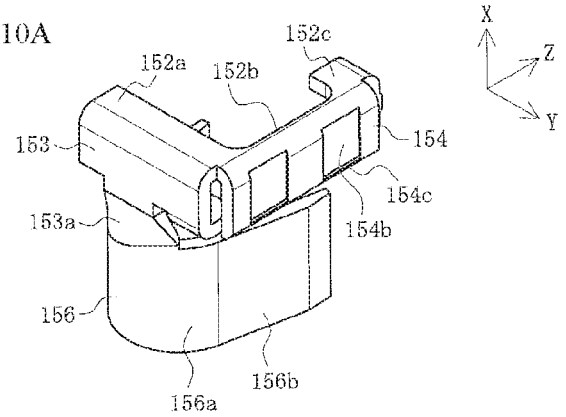
Figure 10B:
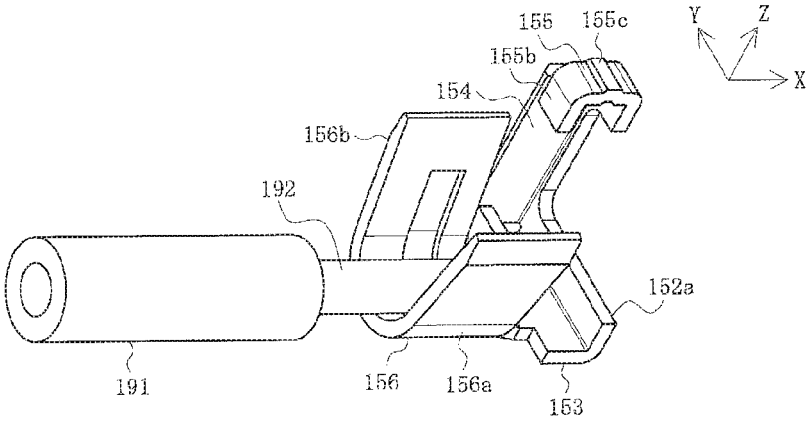
Figure 10C:
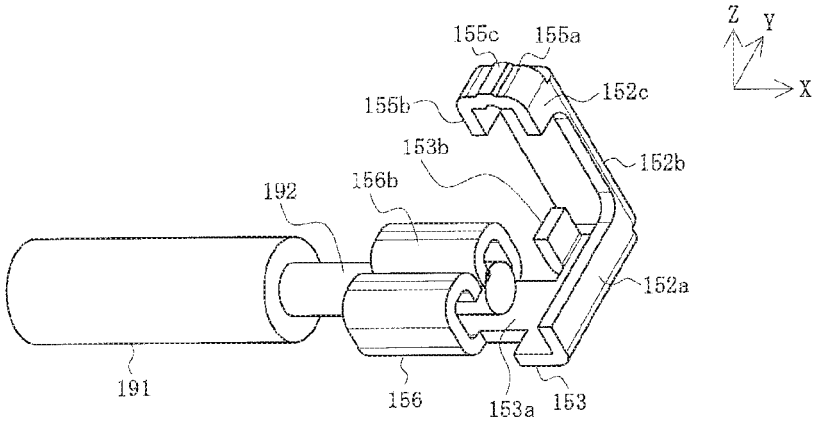

FIG. 8 is a perspective view of the plug connector according to Embodiment 1, FIGS. 9A and 9B are perspective views of a first plug terminal connected to an electric wire according to Embodiment 1, and FIGS. 10A-10C are views describing the process for connecting the first plug terminal to the electric wire according to Embodiment 1. Note that in FIGS. 9A and 9B, FIG. 9A is a perspective view of the first plug terminal connected to the electric wire seen diagonally from above, and FIG. 9B is a perspective view of the first plug terminal connected to the electric wire seen diagonally from below, while in FIGS. 10A-10C, FIG. 10A is a perspective view of the first plug terminal prior to connecting to the electric wire, FIG. 10B is a view illustrating the first process for connecting the electric wire to an electric wire connection part of the first plug terminal, and FIG. 10C is a view illustrating the second process for connecting the electric wire to the electric wire connection part of the first plug terminal.

As mentioned above, the plug connector 101 is a connector having a box shaped outer shape, and includes: a plug housing 111 integrally formed with an insulating material such as resin; and a plug terminal 151 which is integrally formed by subjecting a conductive metal plate to processing such as punching, pressing, and folding. Note that the plug housing 111 is a member integrated with the plug terminal 151 via insert molding (overmolding) and is not independently present (while separated from the plug terminal 151).

In addition, the plug terminal 151 forms a left and right pair, wherein the plug terminal disposed on the left (towards the positive Y-axis direction) is referred to as a first plug terminal 151A, while the plug terminal disposed on the right (towards the negative Y-axis direction) is referred to as a second plug terminal 151B. Note that the first plug terminal 151A and the second plug terminal 151B are configured to be planarly symmetric on the left and right with respect to the X-Z plane passing through the center in the width direction of the plug connector 101, with substantially no difference therebetween in the configuration. With that, when the first plug terminal 151A and the second plug terminal 151B are comprehensively described, they are described as the plug terminal 151. Note that only the first plug terminal 151A is depicted in FIGS. 9A, 9B and 10A-10C for convenience of illustration.

The plug terminal 151 includes: an upper plate part 152 disposed at the upper part; a front plate part 153 disposed on the front; a side plate part 154 disposed on the side; a rear part 155 disposed on the rear; and an electric wire connection part 156 connected to the electric wires 191.

The upper plate part 152 includes: a side upper plate part 152*b* extending in the anteroposterior direction; and a front upper plate part 152*a* and a rear upper plate part 152*c* which stretch from the front end and rear end of this side upper plate part 152*b* towards the center in the width direction of the plug connector 101. Note that in the left and right direction, the dimensions of the front upper plate part 152*a* are set to be larger than those of the rear upper plate part 152*c*. That is, the free end (tip) of the front upper plate part 152*a* is disposed closer to the center in the width direction of the plug connector 101 than the free end of the rear upper plate part 152*c*. The upper plate part 152 has high rigidity and tends not to be deformed because the front upper plate part 152*a*, the side upper plate part 152*b*, and the rear upper plate part 152*c* are integrally connected on the same plane and the shape as seen from above (in a plan view shape) is substantially U shaped.

The front plate part 153 is a flat plate shaped plate member which stretches downward from the front end of the front upper plate part 152*a* of the upper plate part 152 and is exposed to the front surface 111*f* of the plug housing 111. In addition, a connection beam part 153*a* and a front beam part 153*b* are connected to the lower end of the front plate part 153. The connection beam part 153*a* is a band shaped cantilever beam shaped plate member which is connected closer to the free end (tip) of the front plate part 153, that is, closer to the center in the width direction of the plug connector 101, so as to stretch backward, wherein the electric wire connection part 156 is connected to the free end. Moreover, the front beam part 153*b* is a band shaped cantilever beam shaped plate member which is connected closer to the base end of the front plate part 153, that is, in the vicinity of the side plate part 154, so as to stretch backward. Note that in the front plate part 153, a region with the front beam part 153*b* connected to the lower end thereof functions as a contact point region 153*c* contacting the front contact part 53*b* of the receptacle terminal 51.

The electric wire connection part 156 includes a crimping part 156*a* electrically connected to the core wire 192 of the electric wire 191. As with a common crimping terminal, this crimping part 156*a* includes a connection tab 156*b* to be electrically connected to the outer periphery of the core wire 192. Note that in the example illustrated in FIG. 9A, the connection tab 156*b* is in a folding process such that the tip thereof is pressed against the outer periphery of the core wire 192. As mentioned above, the connection beam part 153*a* and the front beam part 153*b* (to which the electric wire connection part 156 is connected to) are disposed at different positions in the left and right direction, that is, in the width direction of the plug connector 101, while the electric wire connection part 156 and the contact point region 153*c* which contacts the receptacle terminal 51 are disposed at different positions in the width direction of the plug connector 101, making it possible to reduce the dimensions in the anteroposterior direction of the receptacle connector 1 and the plug connector 101.

The side plate part 154 is a flat plate shaped plate member which stretches downward from the side end of the side upper plate part 152*b* of the upper plate part 152 and is exposed to the side surface 111*c* of the plug housing 111. In addition, a recess 154*b* is formed on an outer surface 154*a* of the side plate part 154. In the example illustrated in the figure, two recesses 154*b* are formed in parallel in the anteroposterior direction. In addition, a step 154*c* with the outer surface 154*a* is formed at the lower end of each recess 154*b*.

The rear part 155 includes: a rear plate part 155*a* serving as a flat plate shaped plate member which stretches downward from the rear end of the rear upper plate part 152*c* of the upper plate part 152; a rear beam part 155*b* serving as a band shaped cantilever beam shaped plate member which stretches forward from the lower end of this rear plate part 155*a*; and a projection 155*c* which is formed on the outer surface of the rear plate part 155*a* exposed on the rear surface 111*r* of the plug housing 111 so as to protrude backward. Note that this projection 155*c* can be omitted.

Moreover, the contact point region 153*c* and the front beam part 153*b* of the front plate part 153, as well as the rear plate part 155*a* and the rear beam part 155*b* of the rear part 155, are disposed parallel to the X-axis, that is, in nearly a straight line extending in the anteroposterior direction, in a plan view, that is, as seen from above. Moreover, the contact point region 153*c* and the rear plate part 155*a* are turned such that their backs mutually face each other and are integrally formed together with each part of the upper plate part 152, the front plate part 153, the side plate part 154, and the rear part 155. Thereby, the distance between the contact point region 153*c* and the rear plate part 155*a* can be assuredly maintained.

Further, three sides of the electric wire connection part 156 are surrounded by the upper plate part 152, the front plate part 153, the side plate part 154, and the rear part 155, wherein the electric wire connection part 156 does not include the part which protrudes outward from the plug connector 101. Thereby, the plug connector 101 can be reduced in size and height.

Note that in the process as illustrated in FIGS. 10A-10C, the plug terminal 151 is connected to the end of the electric wire 191. Before connecting to this electric wire 191, the plug terminal 151 is processed into the shape as illustrated in FIG. 10A.

Moreover, as illustrated in FIG. 10B, the insulation coat 193 is removed over a predetermined length in the vicinity of the end of the electric wire 191, while the core wire 192 is exposed from the tip of the electric wire 191 by only a predetermined length. In addition, the exposed core wire 192 is positioned so as to abut the inner face of the curved part in the crimping part 156*a* of the electric wire connection part 156.

Subsequently, as illustrated in FIG. 10C, the connection tab 156*b* of the crimping part 156*a* is subjected to a folding process such that the tip thereof is pressed against the outer periphery of the core wire 192.

Finally, a bending process is carried out such that the connection beam part 153*a* is curved at approximately 90°. As a result, as illustrated in FIGS. 9A and 9B, the plug terminal 151 connected to the end of the electric wire 191 can be obtained. Note that in order to stably electrically connect the electric wire 191 and the plug terminal 151, a further connection means such as soldering can be added to the connection position between the core wire 192 and the electric wire connection part 156.

As mentioned above, the plug connector 101 is obtained by integrating the plug housing 111 and the plug terminal 151 via insert molding (overmolding) Specifically, a conductive metal plate is first subjected to processing such as punching, pressing, and folding to mold the first plug terminal 151A and the second plug terminal 151B, with the end of the electric wire 191 further connected thereto. Subsequently, the first plug terminal 151A and the second plug terminal 151B, which are connected to the electric wire 191, are disposed in the molding die so as to abut the inner face in the left and right direction and the anteroposterior direction of a molding die (not illustrated). Subsequently, this molding die is filled with an insulating material such as fused resin and this insulating material is cooled and solidified, after which a molded product is extracted from the molding die. As a result, the plug connector 101 can be obtained, with the plug housing 111 and the plug terminal 151 as illustrated in FIG. 8 integrated. At this time, the electric wire covering part 111*d* is also integrally formed with the plug housing 111, and therefore, does not require a crimping barrel for holding coated parts of electric wires used for general crimping terminals, making it possible to contribute to the reduction in size and height, as well as the cost reduction, of the plug connector 101 and the plug terminal 151.

Note that when the first plug terminal 151A and the second plug terminal 151B are disposed in the molding die as mentioned above, the flow pressure of the fused insulating material which flows in this molding die is applied to each of the first plug terminal 151A and the second plug terminal 151B. As a result, in the first plug terminal 151A and the second plug terminal 151B, each outer surface of the upper plate part 152, the front plate part 153, the side plate part 154, and the rear part 155, as well as each lower face of the front beam part 153*b* and the rear beam part 155*b*, is assuredly adhered to the inner face of the molding die. Consequently, the first plug terminal 151A and the second plug terminal 151B are accurately positioned relative to the plug housing 111, making it possible to reduce the tolerance of the distance between the first plug terminal 151A and the second plug terminal 151B, in addition to obtaining a plug connector 101 having good positional accuracy.

Moreover, the insulating material enters between each part of the plug terminal 151, while the insulating material enters between the first plug terminal 151A and the second plug terminal 151B. Therefore, each part in the plug terminal 151 is integrated with the plug housing 111, thereby preventing each part in the plug terminal 151 from elastically deforming, in addition to preventing changes in the interval between each part of the first plug terminal 151A and each part of the second plug terminal 151B. Thereby, the plug connector 101 can include a rigid structure.

Further, as mentioned above, the contact point region 153*c* and the front beam part 153*b* of the front plate part 153, as well as the rear plate part 155*a* and the rear beam part 155*b* of the rear part 155, are disposed in nearly a straight line extending in the anteroposterior direction, while the contact point region 153*c* and the rear plate part 155*a* are integrally formed together with each part of the upper plate part 152, the front plate part 153, the side plate part 154, and the rear part 155. Therefore, even when force is applied in the anteroposterior direction from the front contact part 53*b* and the rear contact part 54*b* of the receptacle terminal 51, the distance between the contact point region 153*c* and the rear plate part 155*a* does not change. Moreover, the front beam part 153*b* and the rear beam part 155*b* function as beams, making it possible to assuredly prevent the contact point region 153*c* and the rear plate part 155*a* from deforming. Note that the free ends (tips) and upper faces of the front beam part 153*b* and the rear beam part 155*b* are integrally molded and fixed to the plug housing 111.

Further, the electric wire connection part 156 is also contained in the plug housing 111, thereby further increasing the strength of the plug connector 101.

Note that in the present embodiment, an example has been described in which the crimping part 156*a* of the electric wire connection part 156 is crimped to the core wire 192 of the electric wire 191 so as to electrically connect the electric wire connection part 156 and the core wire 192. However, the electric connection between the electric wire connection part 156 and the core wire 192 is not limited to this example. Any connection means such as pressure welding, welding, soldering, etc. of the core wire 192 to the electric wire connection part 156 may be used, or multiple connection means may be used in combination.

The operation for mating the receptacle connector 1 and the plug connector 101 will hereinafter be described.

Figure 11:
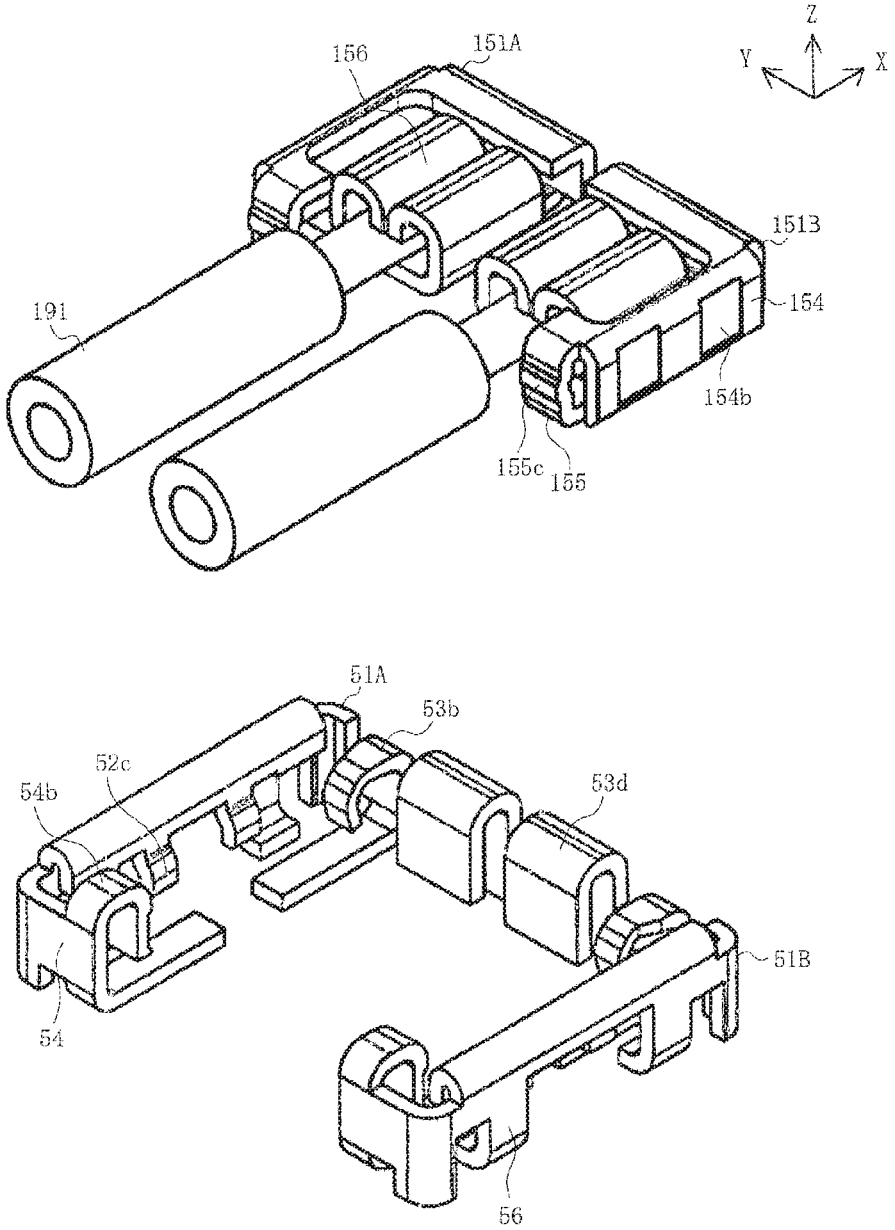
FIG. 11 is a perspective view illustrating the state in which the housing of the receptacle connector and the plug connector is removed immediately prior to mating in Embodiment 1.
Figure 12A:
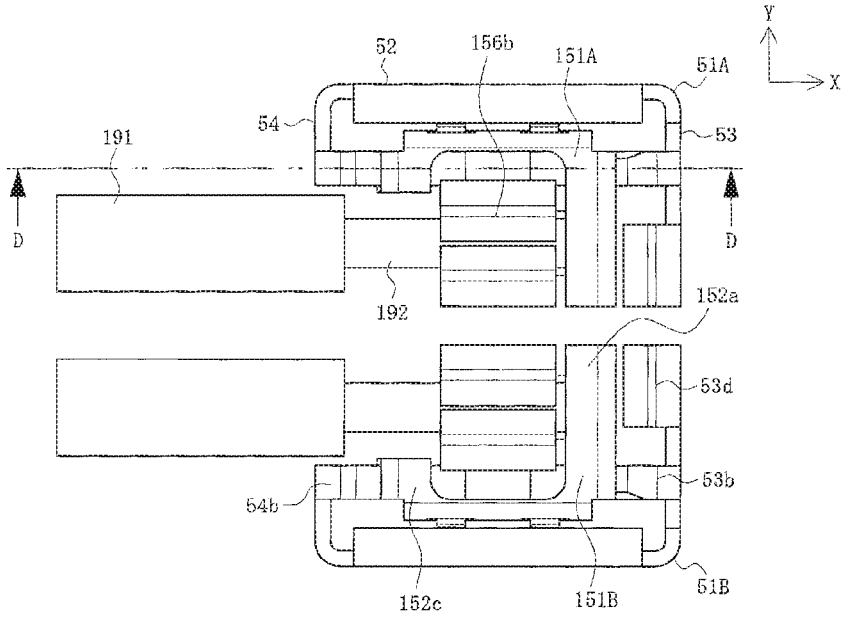
Figure 12B:
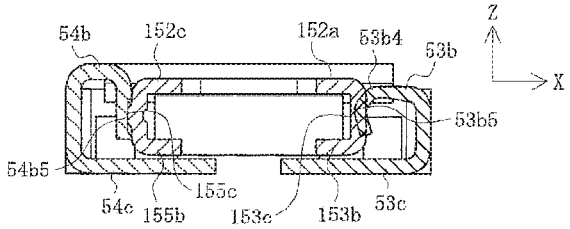

FIG. 11 is a perspective view illustrating the state in which the housing of the receptacle connector and plug connector immediately prior to mating in Embodiment 1 is removed, while FIGS. 12A and 12B are two plane views illustrating the state in which the housing of the mated receptacle connector and plug connector in Embodiment 1 is removed. Note that in FIGS. 12A and 12B, FIG. 12A is a top view, while FIG. 12B is cross sectional view in the arrow direction along line D-D in FIG. 12A.

Here, the receptacle connector 1 is mounted on the surface of the substrate, such that the connection end part 56*b* in the substrate connection part 56 of the receptacle terminal 51 is connected to a conductive pad (which is formed on the surface of a substrate (not illustrated)) via soldering, etc. Moreover, as illustrated in FIG. 8, the plug connector 101 is connected to the end of the electric wire 191.

In addition, as illustrated in FIG. 11, an operator controls the arrangement of the plug connector 101 such that above a receiving space 13 of the receptacle connector 1, the anteroposterior direction, the left and right direction, and the vertical direction of the receptacle connector 1 are congruent with the anteroposterior direction, the left and right direction, and the vertical direction of the plug connector 101. Note that in FIG. 11, in order to facilitate understanding of the positional relationship between the receptacle terminal 51 and the plug terminal 151, the state in which the receptacle housing 11 and the plug housing 111 are removed is depicted.

Subsequently, the operator lowers the plug connector 101 relative to the receptacle connector 1, makes the plug connector 101 enter the receiving space 13 of the receptacle connector 1, and as illustrated in FIGS. 1A, 1B, 2A and 2B, makes the receptacle connector 1 mate with the plug connector 101.

Upon the completion of mating, as illustrated in FIGS. 12A and 12B, a front contact point 53*b*5 serving as the outer surface of the most swollen part in a second curved part 53*b*4 of the front contact part 53*b* of the receptacle terminal 51 contacts the contact point region 153*c* in the front plate part 153 of the plug terminal 151 so as to be conducted. Moreover, the projection 155*c* in the rear plate part 155*a* of the plug terminal 151 engages with and contacts a rear contact point recess 54*b*5 in the contact plate part 54*b*4 of the rear contact part 54*b* of the receptacle terminal 51 so as to be conducted. As a result, the receptacle terminal 51 and the plug terminal 151 are conducted. Consequently, a conductive pad (which is formed on the surface of the substrate) and the electric wire 191 are conducted. Note that the reinforcing part 53*d* of the receptacle terminal 51 does not contact the plug terminal 151.

In the state prior to mating, that is, the state in which force is not applied to the front contact part 53*b* of the receptacle terminal 51, the distance from the front contact point 53*b*5 to the contact plate part 54*b*4 (more specifically, the rear contact point recess 54*b*5) in the receptacle terminal 51 is shorter than the distance from the contact point region 153*c* to the rear plate part 155*a* (more specifically, the projection 155*c*) in the plug terminal 151. Consequently, when mating, the contact point region 153*c* of the plug terminal 151 pushes forward the front contact point 53*b*5 of the receptacle terminal 51, thereby elastically deforming the front contact part 53*b* of the receptacle terminal 51, while elastically displacing forward the front contact point 53*b*5. Upon the completion of mating, the repulsive force exerted by the elastically deformed front contact part 53*b* presses the front contact point 53*b*5 against the contact point region 153*c* of the front plate part 153 of the plug terminal 151, thereby assuredly maintaining contact between the front contact point 53*b*5 and the contact point region 153*c* so as to assure the conduction state therebetween.

Moreover, when mating, the tab part 52*c* of the side part 52 of the receptacle terminal 51 relatively rises along the outer surface 154*a* of the side plate part 154 of the plug terminal 151, passes through the step 154*c*, and engages with a recess 154*b*. At this time, the cantilever beam shaped tab part 52*c* (the vicinity of the lower end of which is bent so as to be disposed closer to the center in the width direction of the receptacle connector 1) is elastically deformed by the step 154*c*, then reaches the recess 154*b* so as to release the elastic force, generating a clicking sound and vibrating. As a result, the operator can easily detect the completion of mating. Note that if the clicking sound and vibrating are unnecessary, the formation of the tab part 52*c*, the recess 154*b*, the step 154*c*, etc. can be omitted. Moreover, in accordance with the usage status of the receptacle connector 1 and the plug connector 101, the presence of the tab part 52*c*, the recess 154*b*, the step 154*c*, etc. may be selected.

Further, in the mated state, the front contact part 53*b* and the rear contact part 54*b* in the receptacle terminal 51, as well as the contact point region 153*c* (of the front plate part 153) and the rear plate part 155*a* in the plug terminal 151, are disposed in nearly a straight line extending in the anteroposterior direction, while the rear contact part 54*b* of the receptacle terminal 51 and the rear plate part 155*a* of the plug terminal 151 abut each other without elastically deforming. Therefore, even when the repulsive force of the front contact part 53*b* of the elastically deformed receptacle terminal 51 acts backward, the rear contact part 54*b* of the receptacle terminal 51 and the rear plate part 155*a* of the plug terminal 151 do not directly attenuate the repulsive force of the front contact part 53*b*. Further, because the front contact point 53*b*5 of the front contact part 53*b* of the receptacle terminal 51 assuredly presses the contact point region 153*c* in the front plate part 153 of the plug terminal 151, a connector assembly can obtain assured connection stability.

Moreover, because the receptacle terminal 51 has a front beam part 53*c* and a rear beam part 54*c* which are disposed in nearly a straight line, even if excessive force (generated when the electric wire 191 is pulled or the receptacle connector 1 erroneously mates with the plug connector 101) is applied via the plug connector 101, the front beam part 53*c* and the rear beam part 54*c* function as beams, preventing the receptacle terminal 51 and the receptacle connector 1 from deforming.

Further, the receptacle terminal 51 has a reinforcing part 53*d* and this reinforcing part 53*d* is integrated with the front wall part 15 of the receptacle housing 11, making it possible to maintain the mechanical strength of the receptacle connector 1 as a whole.

Moreover, an engagement mechanism for maintaining the mating state between the receptacle connector 1 and the plug connector 101 may be included. For example, as illustrated in FIGS. 4B, 5B, etc., the rear contact point recess 54*b*5 is formed on the contact plate part 54*b*4 of the rear contact part 54*b* of the receptacle terminal 51, while as illustrated in FIG. 10B, etc., the projection 155*c* is formed on the outer surface of the rear plate part 155*a* of the plug terminal 151 so as to make the rear contact point recess 54*b*5 engage with the projection 155*c*. As a result, the mating state between the receptacle connector 1 and the plug connector 101 can be maintained. Moreover, the rear contact point recess 54*b*5 and the projection 155*c* function as second electrical contact points.

Further, the bottom wall part 12 of the receptacle housing 11 is absent behind the rear end of the main body part 12*a*, while the lower part of the receiving space 13 is opened in the range from the rear end of this main body part 12*a* to the rear wall part 16 so as to form even more space. Consequently, even if the underside of the electric wire 191 and the electric wire covering part 111*d* which are connected to the plug connector 101 protrudes below a bottom surface 111*b* of the plug housing 111, that is, the electric wire 191 having a larger outer diameter than the dimensions in the vertical direction of the plug connector 101 is used, because the underside of the protruding electric wire 191 and electric wire covering part 111*d* is housed in the further space, the dimensions (height) in the vertical direction of the mutually mated receptacle connector 1 and plug connector 101, that is, the connector assembly, can be maintained.

In this way, in the present embodiment, the receptacle connector 1 includes the receptacle housing 11, along with the receptacle terminal 51 installed in the receptacle housing 11; wherein the receptacle housing 11 includes: the receiving space 13 in which the upper face receiving the plug connector 101 is opened; a pair of side wall parts 14 defining at least a portion of both the left and right sides of the receiving space 13; the front wall part 15 defining at least a portion of the front of the receiving space 13; and a pair of rear wall parts 16 defining at least a portion of the rear of the receiving space 13, wherein the receptacle terminal 51 includes: the front contact part 53*b* provided on the front of the receiving space 13 adjacent to each side wall part 14; and the rear contact part 54*b* provided on the rear of the receiving space 13 adjacent to each side wall part 14, and wherein the front contact part 53*b* and the rear contact part 54*b* are disposed in nearly a straight line extending in the anteroposterior direction, face each other, and are capable of holding the plug terminal 151 of the plug connector 101 from the front and rear thereof.

As a result, the receptacle connector 1 provides a simple configuration which, even upon a reduction in size and height, is able to assuredly maintain the conduction state with the plug terminal 151 of the plug connector 101 in addition to assuredly maintaining the mating state with the plug connector 101. Thereby, reliability can be improved.

Moreover, the front contact part 53*b* and the rear contact part 54*b* elastically holds the plug terminal 151 when the front contact part 53*b* elastically deforms. Therefore, the rear contact part 54*b* can define the position of the plug terminal 151 in terms of the receptacle terminal 51, wherein the positional relationship between the receptacle terminal 51 and the plug terminal 151, as well as the positional relationship between the receptacle connector 1 and the plug connector 101, can be stably maintained.

Further, the front contact part 53*b* is an elastically deformable band plate shaped member separated from the front wall part 15, and includes: an arm part 53*b*3 which stretches towards the rear of the receiving space 13; and a second curved part 53*b*4 connected to the tip of the arm part 53*b*3, wherein the rear contact part 54*b* is integrated with at least a portion of the rear wall part 16. Therefore, the second curved part 53*b*4 contacting the plug terminal 151 in the front contact part 53*b* can be sufficiently elastically displaced, while assuredly preventing the rear contact part 54*b* from elastically deforming. Thereby, while assuredly maintaining the contact and conduction state between the receptacle terminal 51 and the plug terminal 151, the positional relationship between the receptacle terminal 51 and the plug terminal 151, as well as the positional relationship between the receptacle connector 1 and the plug connector 101, can be stably maintained.

Further, the rear contact point recess 54*b*5 engageable with the plug terminal 151 is formed on the surface of the rear contact part 54*b* facing the front of the receiving space 13. Therefore, the engagement between the rear contact part 54*b* and the plug terminal 151 which do not elastically deform is assuredly maintained, such that the plug terminal 151 and the receptacle terminal 51 are locked with high locking strength.

Further, the receptacle terminal 51 includes a side part 52 which is integrated with at least a portion of the side wall part 14 so as to be exposed to the outer surface, wherein the front contact part 53*b* and the rear contact part 54*b* are respectively connected to the front end and rear end of the side part 52. In this way, the front contact part 53*b* and the rear contact part 54*b* are connected to the side part 52 (which is a member having high strength) to provide a stable positional relationship therebetween, thereby providing a stable positional relationship between the receptacle terminal 51 and the plug terminal 151 which is held by the front contact part 53*b* and the rear contact part 54*b* from the front and rear thereof.

Further, the receptacle terminal 51 includes a reinforcing part 53*d* which is integrated with at least a portion of the front wall part 15 so as to be exposed to the outer surface, wherein the reinforcing part 53*d* is provided closer to the center in the width direction of the receptacle housing 11 than the front contact part 53*b* so as not to contact the plug terminal 151. Thereby, the strength of the receptacle connector 1 is improved.

Further, the plug connector 101 includes: the plug housing 111; and the plug terminal 151 which is connected to the end of the electric wire 191 and installed in the plug housing 111; wherein the periphery of the plug housing 111 is defined by an upper surface 111*a*, a bottom surface 111*b*, left and right side surfaces 111*c*, a front surface 111*f*, and a rear surface 111*r*, wherein the electric wire 191 stretches backward from the rear surface 111*r*, and wherein the plug terminal 151 includes: the front plate part 153 exposed to the front surface 111*f*; and the rear plate part 155*a* exposed to the rear surface 111*r*, wherein the front plate part 153 includes the contact point region 153*c* which is disposed more externally in the width direction of the plug housing 111 than the electric wire 191 so as to be adjacent to the side surfaces 111*c*, with the contact point region 153*c* and the rear plate part 155*a* disposed in nearly a straight line extending in the anteroposterior direction so as to be capable of being held by the front contact part 53*b* and the rear contact part 54*b* of the receptacle terminal 51 of the receptacle connector 1 from the front and rear thereof. In this way, the contact point region 153*c* and the rear plate part 155*a* disposed on the front and rear of the plug terminal 151 are capable of being held by the front contact part 53*b* and the rear contact part 54*b* of the receptacle terminal 51 from the front and rear thereof, thereby improving the positional accuracy of the plug terminal 151 to the receptacle terminal 51, as well as the positional accuracy of the plug connector 101 to the receptacle connector 1. Moreover, the plug connector 101 is retained in the receptacle connector 1 at high positional accuracy even when the dimensional accuracy in the width direction is low.

Next Embodiment 2 will be described. Note that the description of elements having the same structures as those of Embodiment 1 will be omitted by being denoted by the same reference numerals. Furthermore, a description of operations and effects that are the same as those of Embodiment 1 will be omitted.

Figure 13:
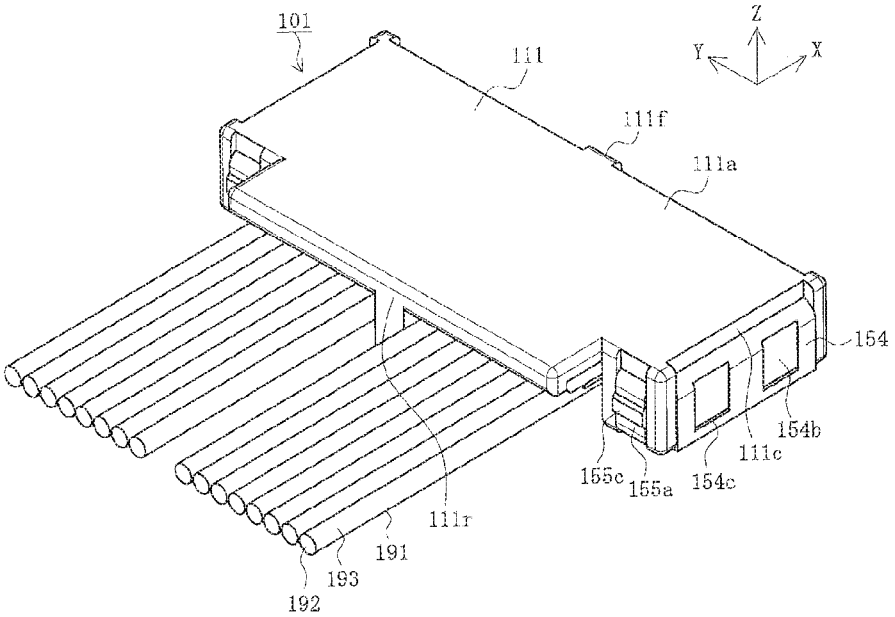
FIG. 13 is a perspective view illustrating the state the housing of the receptacle connector and plug connector immediately prior to mating in Embodiment 2.
Figure 13:
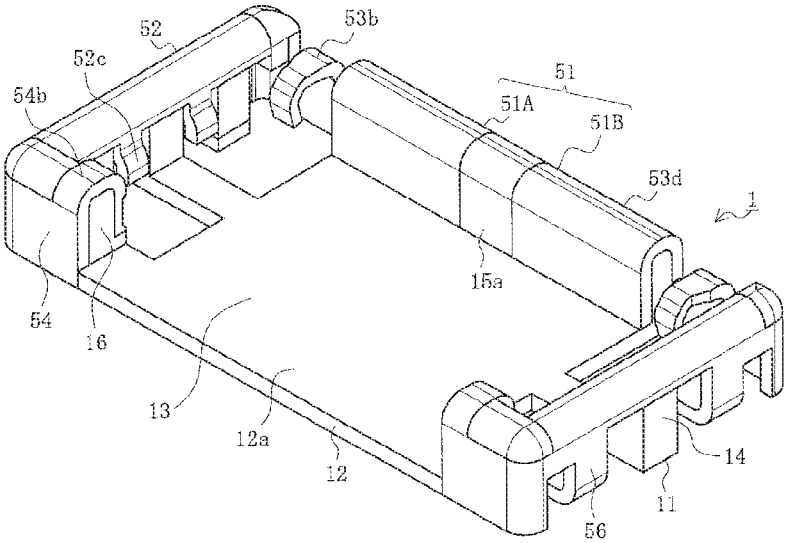
Figure 14A:
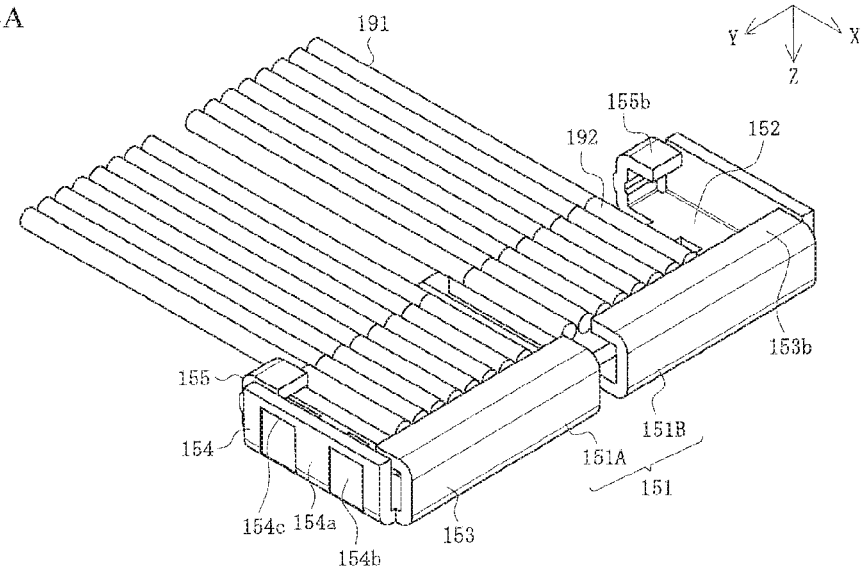
Figure 14B:
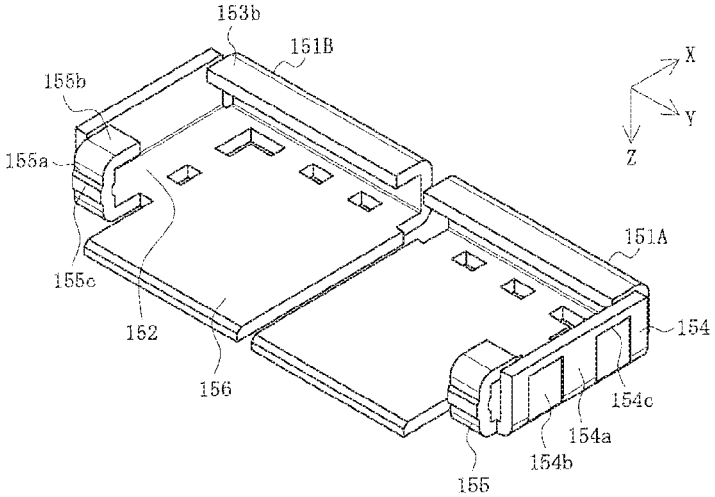

FIG. 13 is a perspective view illustrating the state the housing of the receptacle connector and plug connector immediately prior to mating in Embodiment 2, while FIGS. 14A and 14B are perspective views of the plug connector according to Embodiment 2 seen diagonally from below. Note that in FIGS. 14A and 14B, FIG. 14A is a view illustrating the state in which the housing is removed, while FIG. 14B is a view illustrating the state of a plug terminal alone.

The electric wire 191 connected to the plug connector 101 as an electric wire connector in the present embodiment has a smaller outer diameter than the electric wire 191 in the abovementioned Embodiment 1, in addition to having a large number, and configures rows arranged in parallel in the width direction of the plug connector 101 (in the example illustrated in the figure, eight electric wires are arranged in parallel in one row in the width direction of the plug connector 101 so as to configure one row on both the left and right). The electric wire 191 in the present embodiment is typically an electric wire (having a small diameter) referred to as a magnet wire, is generally used while wound in a coil shape, for example, and has a core wire 192 as a conductive electric wire made of a conductive metal such as copper alloy and an insulation coat 193 (which is enamel, polyimide, etc. and coats the periphery of this core wire 192), in addition to having an outer diameter of approximately 0.03 to 0.25 [mm], with any kind thereof capable of being used. In addition, as illustrated in FIG. 14A, the insulation coat 193 is removed over a predetermined length in the vicinity of the end of the electric wire 191, while the core wire 192 is exposed from the tip of the electric wire 191 by only a predetermined length.

Moreover, as illustrated in FIG. 14B, the electric wire connection part 156 of the plug terminal 151 in the present embodiment is a substantially rectangular flat plate shaped plate member integrated with the upper plate part 152 and extends to the rear of the rear part 155, with the dimensions in the left and right direction equal to those of the front plate part 153. Further, the plug terminal 151 in the present embodiment does not include the crimping part 156*a* including the connection tab 156*b* which is possessed by the electric wire connection part 156 in the abovementioned Embodiment 1, while the core wire 192 of the electric wire 191 is electrically connected to the lower face (surface in the negative Z-axis direction) thereof via a connection means such as soldering.

Note that compared with the plug terminal 151 according to the abovementioned Embodiment 1, while the plug terminal 151 according to the present embodiment has different ratios between the dimensions in the left and right direction and the dimensions in the anteroposterior direction and the vertical direction, it does have substantially the same structure except in the abovementioned respect, so descriptions thereof have been omitted.

In addition, as in the abovementioned Embodiment 1, the plug connector 101 in the present embodiment is also obtained by integrating the plug housing 111 and the plug terminal 151 via insert molding (overmolding), wherein the first plug terminal 151A and the second plug terminal 151B which are connected to the electric wire 191 are disposed in the molding die while maintaining the arrangement as illustrated in FIG. 14A, after which this molding die is filled with an insulating material such as fused resin. After this insulating material is cooled and solidified, a molded product can be extracted from the molding die to obtain the plug connector 101. As a result, a plug connector 101 can be obtained, with the plug housing 111 and the plug terminal 151 as illustrated in FIG. 13 integrated.

Moreover, compared with the receptacle connector 1 in the abovementioned Embodiment 1, as illustrated in FIG. 13, the receptacle connector 1 as a substrate connector in the present embodiment has different ratios between the dimensions in the left and right direction and the dimensions in the anteroposterior direction and the vertical direction. Further, while the front beam part 53*c* and the rear beam part 54*c* of the receptacle terminal 51 are omitted, the main body part 12*a* of the bottom wall part 12 extends to the rear wall part 16 so as to be integrally connected to this rear wall part 16. Therefore, the receiving space 13 does not include a part with the lower part opened.

Note that because the receptacle connector 1 according to the present embodiment has substantially the same structure as the receptacle connector 1 according to the abovementioned Embodiment 1 except in the abovementioned respect, descriptions thereof have been omitted.

It should be noted that descriptions of the configurations, operations, and effects of other aspects of the receptacle connector 1 and the plug connector 101 that are the same as those of Embodiment 1 have been omitted.

Next, a third embodiment will be described. It should be noted that the description of elements having the same structure as the first and second embodiments will be omitted by denoting these elements using the same reference numerals. Furthermore, descriptions of operations and effects that are the same as those of the first and second embodiments will also be omitted.

Figure 15A:
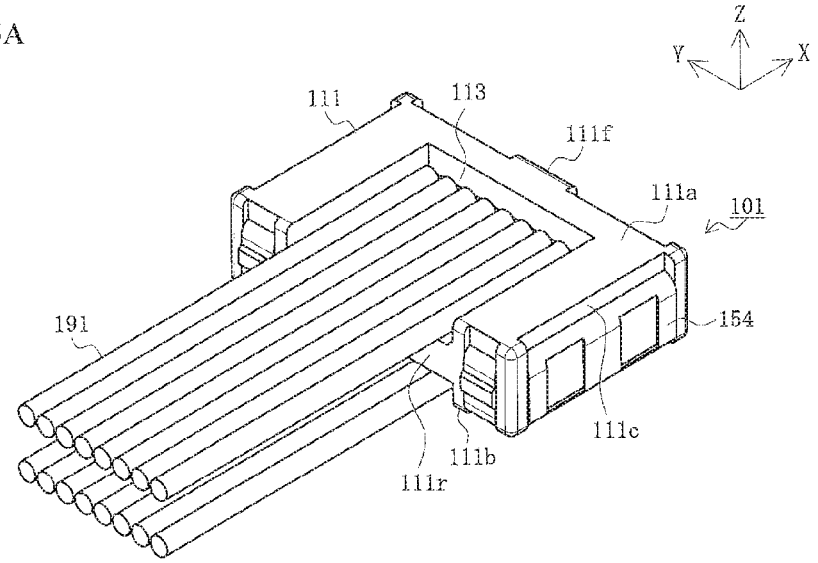
Figure 15B:
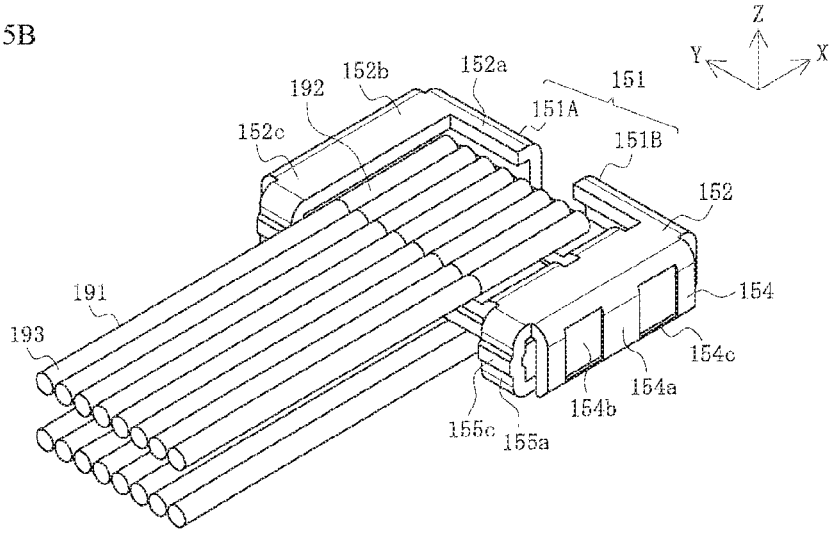
Figure 16A:
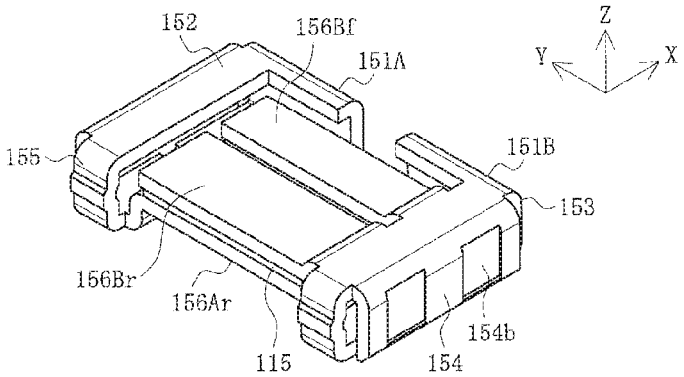
Figure 16B:
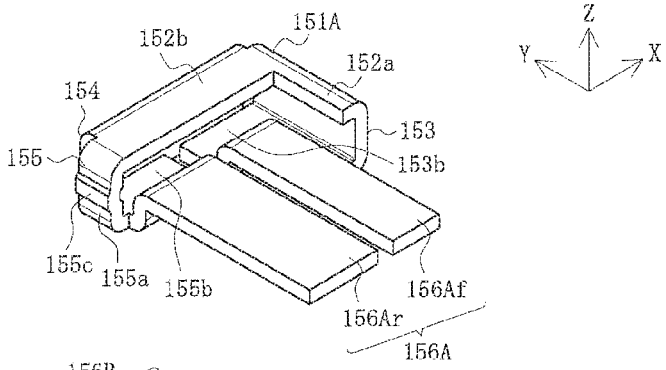
Figure 16C:
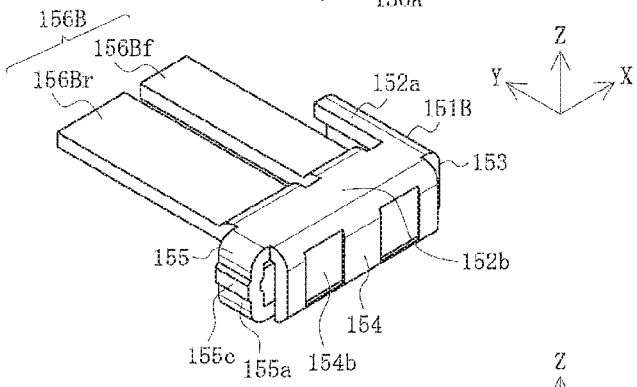
Figure 16D:
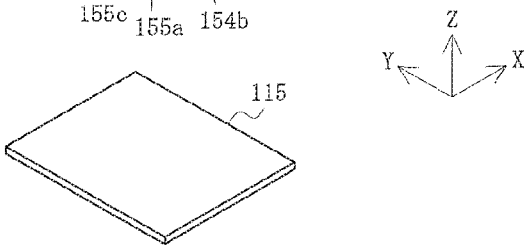
Figure 17:
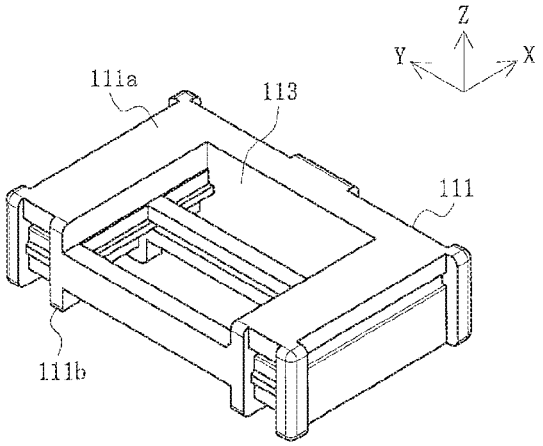
FIG. 17 is a perspective view illustrating the plug housing according to Embodiment 3.
Figure 18:
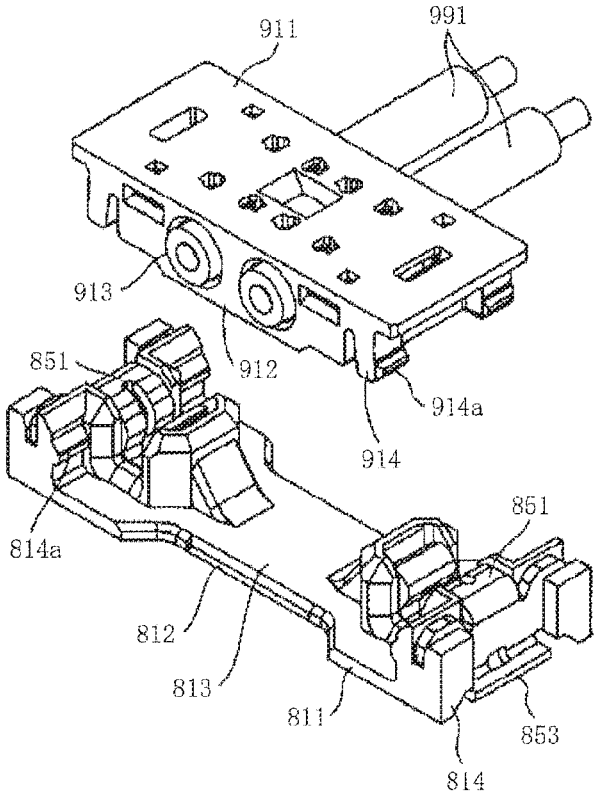
FIG. 18 is a perspective view prior to the mating of a conventional connector.

FIGS. 15A and 15B are perspective views of a plug connector according to Embodiment 3, FIGS. 16A-16D are perspective views of each part of a plug terminal according to Embodiment 3, and FIG. 17 is a perspective view illustrating the plug housing according to Embodiment 3. Note that in FIGS. 15A and 15B, FIG. 15A is a perspective view of the plug connector seen diagonally from above, while FIG. 15B is a perspective view illustrating the state in which a plug housing is removed from FIG. 15A. In contrast, in FIGS. 16A-16D, FIG. 16A is a perspective view of the plug terminal, FIG. 16B is a perspective view of a first plug terminal, FIG. 16C is a perspective view of a second plug terminal, and FIG. 16D is a perspective view of an insulating plate between terminals.

The electric wire 191 connected to the plug connector 101 as the electric wire connector in the present embodiment is the same as in the abovementioned Embodiment 2, wherein rows arranged in parallel in the width direction of the plug connector 101 are disposed to form vertical multiple rows (in the example illustrated in the figure, two vertical rows).

In addition, an electric wire housing recess 113 is formed in the center of the plug housing 111, wherein the core wire 192 which is exposed by a predetermined length from the tip of the electric wire 191 is housed in the electric wire housing recess 113. This electric wire housing recess 113 is a substantially rectangular-parallelepiped space which is opened to the upper surface 111*a*, the bottom surface 111*b*, and the rear surface 111*r* of the plug housing 111. Note that while the plug housing 111 is a member integrated with the plug terminal 151 via insert molding (overmolding) and is not independently present (while separated from the plug terminal 151), for convenience of description, it is depicted as independently present in FIG. 17.

As illustrated in FIG. 16B, a first electric wire connection part 156A serving as an electric wire connection part of the first plug terminal 151A in the present embodiment is a band shaped flat plate shaped plate member extending in the width direction of the plug connector 101 and includes a first front electric wire connection part 156Af and a first rear electric wire connection part 156Ar, wherein one end thereof is connected to the side end on the center side in the width direction of the plug connector 101 in the front beam part 153*b* and the rear beam part 155*b*. Note that when the first front electric wire connection part 156Af and the first rear electric wire connection part 156Ar are comprehensively described, they are described as the first electric wire connection part 156A. Moreover, parts connected to the front beam part 153*b* and the rear beam part 155*b* in the first front electric wire connection part 156Af and the first rear electric wire connection part 156Ar have a crank shaped cross section. As a result, the lower face (surface in the negative Z-axis direction) in the first front electric wire connection part 156Af and the first rear electric wire connection part 156Ar is disposed above the lower face in the front beam part 153*b* and the rear beam part 155*b*. Further, the first electric wire connection part 156A does not include the crimping part 156*a* including the connection tab 156*b* which is possessed by the electric wire connection part 156 in the abovementioned Embodiment 1, while the core wire 192 of the electric wire 191 is electrically connected to the lower face thereof via a connection means such as soldering.

Moreover, as illustrated in FIG. 16C, a second electric wire connection part 156B serving as an electric wire connection part of the second plug terminal 151B in the present embodiment is a band shaped flat plate shaped plate member extending in the width direction of the plug connector 101 and includes a second front electric wire connection part 156Bf and a second rear electric wire connection part 156Br, wherein one end thereof is connected to the side end on the center side in the width direction of the plug connector 101 in the side upper plate part 152*b*. Note that when the second front electric wire connection part 156Bf and the second rear electric wire connection part 156Br are comprehensively described, they are described as the second electric wire connection part 156B. Moreover, parts connected to the side upper plate part 152*b* in the second front electric wire connection part 156Bf and the second rear electric wire connection part 156Br have a crank shaped cross section. As a result, the upper face (surface in the positive Z-axis direction) in the second front electric wire connection part 156Bf and the second rear electric wire connection part 156Br is disposed below the upper face in the side upper plate part 152*b*. Further, the second electric wire connection part 156B does not include the crimping part 156*a* including the connection tab 156*b* which is possessed by the electric wire connection part 156 in the abovementioned Embodiment 1, while the core wire 192 of the electric wire 191 is electrically connected to the upper face thereof via a connection means such as soldering.

In the present embodiment, as illustrated in FIG. 16A, the first plug terminal 151A and the second plug terminal 151B are relatively positioned. Specifically, the second front electric wire connection part 156Bf and the second rear electric wire connection part 156Br are respectively disposed above the first front electric wire connection part 156Af and the first rear electric wire connection part 156Ar so as to overlap each other. In addition, an intermediate insulating sheet 115 as an insulating plate (between terminals) made of an insulating material such as resin is provided between the upper face of the first front electric wire connection part 156Af and the first rear electric wire connection part 156Ar and the lower face of the second front electric wire connection part 156Bf and the second rear electric wire connection part 156Br. By interposing this intermediate insulating sheet 115, the first front electric wire connection part 156Af and the first rear electric wire connection part 156Ar can be prevented from mutually contacting the second front electric wire connection part 156Bf and the second rear electric wire connection part 156Br, preventing the first plug terminal 151A and the second plug terminal 151B from short-circuiting. Note that as illustrated in FIG. 16D, the intermediate insulating sheet 115 is a substantially rectangular plate member.

In addition, as in the abovementioned Embodiment 2, the plug connector 101 in the present embodiment is also obtained by integrating the plug housing 111 and the plug terminal 151 via insert molding (overmolding), wherein the first plug terminal 151A and the second plug terminal 151B which are connected to the electric wire 191 are disposed in the molding die while maintaining the arrangement as illustrated in FIG. 15B, after which this molding die is filled with an insulating material such as fused resin. After this insulating material is cooled and solidified, a molded product can be extracted from the molding die to obtain the plug connector 101. As a result, the plug connector 101 can be obtained, wherein the plug housing 111 and the plug terminal 151 as illustrated in FIG. 15A are integrated.

Note that because the receptacle connector 1 according to the present embodiment has substantially the same structure as the receptacle connector 1 according to the abovementioned Embodiment 1, descriptions thereof have been omitted.

Moreover, it should be noted that descriptions of the configurations, operations, and effects of other aspects of the receptacle connector 1 and the plug connector 101 that are the same as those of Embodiments 1 and 2 will be omitted.

Further, the disclosure of the present specification describes characteristics related to a preferred and exemplary embodiment. Various other embodiments, modifications, and variations within the scope and spirit of the claims appended hereto could naturally be conceived of by persons skilled in the art by summarizing the disclosures of the present specification.

The present disclosure is applicable to a connector and a connector assembly.

What is claimed is:

1. A substrate connector, comprising:
a housing; and
a terminal installed in the housing,
wherein the housing comprises:
a receiving space which is open via an upper portion thereof to define an upper opening of the receiving space,
a pair of side wall parts defining at least a portion of both a left side and a right side of the receiving space,
a front wall part defining at least a portion of a front of the receiving space, and
a pair of rear wall parts defining at least a portion of a rear of the receiving space, the pair of rear wall parts being separated from one another, the receiving space being open via the rear thereof between the pair of rear wall parts to define a rear opening of the receiving space, and
wherein the terminal comprises:
a front contact part provided on the front of the receiving space so as to be adjacent to each side wall part, and
a rear contact part provided on the rear of the receiving space so as to be adjacent to each side wall part, and
wherein the upper opening of the receiving space is configured to receive an electric wire connector therein,
wherein the rear opening of the receiving space is configured to allow an electric wire of the electric wire connector to extend outwardly from the housing of the substrate connector, and
wherein the front contact part and the rear contact part are disposed in nearly a straight line extending in an anteroposterior direction, face each other, and are configured to hold a counterpart terminal of the electric wire connector from the front and rear thereof, and
wherein the front contact part and the rear contact part are configured to elastically hold the counterpart terminal when the front contact part elastically deforms.

2. The substrate connector according to claim 1, wherein the front contact part is an elastically deformable band plate shaped member separated from the front wall part, the front contact part includes: an arm part which stretches towards the rear of the receiving space, and a contact curved part connected to a tip of the arm part, and wherein the rear contact part is integrated with at least a portion of the rear wall part.

3. The substrate connector according to claim 2, wherein the rear contact part has a recess formed on a surface facing the front of the receiving space, the recess configured to engage with the counterpart terminal.

4. A substrate connector, comprising:
a housing; and
a terminal installed in the housing,
wherein the housing comprises:
a receiving space which is open via an upper portion thereof to define an upper opening of the receiving space,
a pair of side wall parts defining at least a portion of both a left side and a right side of the receiving space,
a front wall part defining at least a portion of a front of the receiving space, and
a pair of rear wall parts defining at least a portion of a rear of the receiving space, the pair of rear wall parts being separated from one another, the receiving space being open via the rear thereof between the pair of rear wall parts to define a rear opening of the receiving space, and
wherein the terminal comprises:
a front contact part provided on the front of the receiving space so as to be adjacent to each side wall part, and
a rear contact part provided on the rear of the receiving space so as to be adjacent to each side wall part, and
wherein the upper opening of the receiving space is configured to receive an electric wire connector therein,
wherein the rear opening of the receiving space is configured to allow an electric wire of the electric wire connector to extend outwardly from the housing of the substrate connector, and
wherein the front contact part and the rear contact part are disposed in nearly a straight line extending in an anteroposterior direction, face each other, and are configured to hold a counterpart terminal of the electric wire connector from the front and rear thereof, and
wherein the terminal includes a side part which is integrated with at least a portion of the side wall part so as to be exposed to an outer surface of the housing, and wherein the front contact part and the rear contact part are respectively connected to a front end and a rear end of the side part.

5. A substrate connector, comprising:
a housing; and
a terminal installed in the housing,
wherein the housing comprises:
a receiving space which is open via an upper portion thereof to define an upper opening of the receiving space,
a pair of side wall parts defining at least a portion of both a left side and a right side of the receiving space,
a front wall part defining at least a portion of a front of the receiving space, and
a pair of rear wall parts defining at least a portion of a rear of the receiving space, the pair of rear wall parts being separated from one another, the receiving space being open via the rear thereof between the pair of rear wall parts to define a rear opening of the receiving space, and wherein the terminal comprises:

a front contact part provided on the front of the receiving space so as to be adjacent to each side wall part, and a rear contact part provided on the rear of the receiving space so as to be adjacent to each side wall part, and wherein the upper opening of the receiving space is configured to receive an electric wire connector therein, wherein the rear opening of the receiving space is configured to allow an electric wire of the electric wire connector to extend outwardly from the housing of the substrate connector, and wherein the front contact part and the rear contact part are disposed in nearly a straight line extending in an anteroposterior direction, face each other, and are configured to hold a counterpart terminal of the electric wire connector from the front and rear thereof, and wherein the terminal includes a reinforcing part which is integrated with at least a portion of the front wall part so as to be exposed to an outer surface of the housing, and wherein the reinforcing part is provided closer to a center in a width direction of the housing than the front contact part so as not to be configured to contact the counterpart terminal.

6. A connector assembly comprising:

a substrate connector; and an electric wire connector capable of mating with the substrate connector, wherein the substrate connector comprises:

a housing; and a terminal installed in the housing, wherein the housing comprises:

a receiving space which is open via an upper portion thereof to define an upper opening of the receiving space, a pair of side wall parts defining at least a portion of both a left side and a right side of the receiving space, a front wall part defining at least a portion of a front of the receiving space, and a pair of rear wall parts defining at least a portion of a rear of the receiving space, the pair of rear wall parts being separated from one another, the receiving space being open via the rear thereof between the pair of rear wall parts to define a rear opening of the receiving space, and wherein the terminal comprises:

a front contact part provided on the front of the receiving space so as to be adjacent to each side wall part, and a rear contact part provided on the rear of the receiving space so as to be adjacent to each side wall part, and wherein the electric wire connector comprises: a counterpart housing; and a counterpart terminal which is connected to an end of an electric wire and installed in the counterpart housing;

a periphery of the counterpart housing is defined by an upper surface, a bottom surface, left and right side surfaces, a front surface, and a rear surface;

the electric wire stretches backward from the rear surface; and the counterpart terminal includes: a front plate part exposed to the front surface; and a rear plate part exposed to the rear surface, wherein the front plate part includes a contact point region which is disposed more externally in a width direction of the counterpart housing than the electric wire so as to be adjacent to the side surfaces, with the contact point region and the rear plate part disposed in nearly a straight line extending in the anteroposterior direction so as to be capable of being held by the front contact part and the rear contact part of the terminal of the substrate connector from the front and rear thereof, wherein the upper opening of the receiving space is configured to receive the electric wire connector therein, wherein the rear opening of the receiving space is configured to allow the electric wire of the electric wire connector to extend outwardly from the housing of the substrate connector, wherein the front contact part and the rear contact part are disposed in nearly a straight line extending in an anteroposterior direction, face each other, and are configured to hold the counterpart terminal of the electric wire connector from the front and rear thereof.

* * * * *